US006849369B2

(12) United States Patent
Yagi et al.

(10) Patent No.: US 6,849,369 B2
(45) Date of Patent: Feb. 1, 2005

(54) TONER FOR DEVELOPING ELECTROSTATIC IMAGE, METHOD FOR MANUFACTURING THE TONER, DEVELOPER INCLUDING THE TONER, CONTAINER CONTAINING THE TONER, AND DEVELOPING METHOD USING THE TONER

(75) Inventors: Shinichiro Yagi, Numazu (JP); Masami Tomita, Numazu (JP); Toshiki Nanya, Mishima (JP); Shigeru Emoto, Numazu (JP); Hiroshi Yamada, Numazu (JP); Hiroshi Yamashita, Numazu (JP); Naohiro Watanabe, Suntoh-gun (JP); Tsunemi Sugiyama, Numazu (JP); Tadao Takigawa, Shinshiro (JP)

(73) Assignee: Ricoh Company, Limited, Tokyo (JP)

( * ) Notice: Subject to any disclaimer, the term of this patent is extended or adjusted under 35 U.S.C. 154(b) by 75 days.

(21) Appl. No.: 10/284,177

(22) Filed: Oct. 31, 2002

(65) Prior Publication Data

US 2003/0138717 A1 Jul. 24, 2003

(30) Foreign Application Priority Data

Nov. 2, 2001 (JP) ..... 2001-338383
Nov. 2, 2001 (JP) ..... 2001-338406
May 31, 2002 (JP) ..... 2002-160694

(51) Int. Cl.[7] ..... G03G 9/093
(52) U.S. Cl. ..... 430/110.4; 430/109.4; 430/108.1
(58) Field of Search ..... 430/110.4, 109.4, 430/108.1

(56) References Cited

U.S. PATENT DOCUMENTS 5,219,694 A 6/1993 Anno et al.
5,541,031 A 7/1996 Yamashita et al.
5,679,490 A * 10/1997 Yachi et al. ..... 430/109.4
6,103,440 A 8/2000 Lohr
6,303,258 B1 10/2001 Katoh et al.
6,360,068 B1 3/2002 Kinoshita et al.
6,363,229 B1 3/2002 Shiraishi et al.
6,395,443 B2 5/2002 Kuroda et al.
6,403,275 B1 6/2002 Kuramoto et al.
6,432,589 B1 8/2002 Uchinokura et al.
6,468,706 B2 10/2002 Matsuda et al.

FOREIGN PATENT DOCUMENTS

| | | |
|---|---|---|
| EP | 0 455 986 | 9/1991 |
| EP | 0 523 733 | 1/1993 |
| EP | 1 146 397 | 10/2001 |
| EP | 1 239 334 | 9/2002 |
| JP | 63-186253 | 8/1988 |
| JP | 08-254853 | 10/1996 |
| JP | 2000-292973 | 10/2000 |
| JP | 2000-292978 | 10/2000 |

* cited by examiner

*Primary Examiner*—Mark A. Chapman
(74) *Attorney, Agent, or Firm*—Oblon, Spivak, McClelland, Maier & Neustadt, P.C.

(57) ABSTRACT

Toner particles including a binder resin; a colorant; and a particulate resin which is present at least on a surface of the toner particles and which has a glass transition temperature of form 50 to 90° C., wherein a ratio (Dv/Dn) of a volume average particle diameter (Dv) of the toner particles to a number average particle diameter (Dn) thereof is from 1.00 to 1.40 and the surface of the toner particles is covered with the particulate resin at a covering ratio of from 1 to 90 %. A method for manufacturing the toner particles is provided. A developer including a toner including the toner particles is provided. A developing method using a toner including the toner particles is provided. A toner container containing the toner particles is provided.

23 Claims, 2 Drawing Sheets

TONER FOR DEVELOPING ELECTROSTATIC IMAGE, METHOD FOR MANUFACTURING THE TONER, DEVELOPER INCLUDING THE TONER, CONTAINER CONTAINING THE TONER, AND DEVELOPING METHOD USING THE TONER

BACKGROUND OF THE INVENTION

1. Field of the Invention

The present invention relates to a toner for visualizing an electrostatic latent image formed on an image bearing member by a method such as electrophotography and electrostatic recording methods. In addition, the present invention also relates to a developer including a toner, a developing method using a toner and a toner container containing a toner.

2. Discussion of the Background

Electrostatic latent images and magnetic latent images, which are formed on an image bearing member of an electrophotographic image forming apparatus or electrostatic recording apparatus are developed with a toner to be visualized.

For example, in electrophotography visual images are typically formed as follows:

(1) an electrostatic latent image is formed on a photoreceptor;
(2) the electrostatic latent image is developed with a developer including a toner to form a toner image on the photoreceptor;
(3) the toner image is transferred onto a receiving material such as papers; and
(4) the toner image on the receiving material is fixed upon application of heat, etc. to form a hard copy.

Recently, a need exists for an electrophotographic image forming apparatus and a developer therefor, which can produce high quality images. In order to produce high quality images, it is essential for the toner included in a developer to have a sharp particle diameter distribution because each of the toner particles can exhibit uniform performance and thereby fine dot images can be well reproduced.

The toners used for developing electrostatic latent images are colored particles typically including a binder resin, and a colorant, a charge controlling agent and additives which are dispersed in the binder resin. The methods for manufacturing the toners are broadly classified into pulverization methods and suspension polymerization methods.

Pulverization methods typically include the following processes:

(1) mixing a colorant, a charge controlling agent, an offset preventing agent and the like materials with a thermoplastic resin upon application of heat thereto to knead the toner constituents;
(2) cooling the kneaded mixture;
(3) pulverizing the kneaded mixture to form a color powder; and
(4) classifying the color powder to form a toner.

The toners prepared by pulverization methods have fair characteristics. However, the pulverization methods have a drawback in that only limited materials can be used as the toner constituents (particularly, as the binder resin). Namely, the kneaded mixture has to be easily pulverized and classified by conventional low-cost pulverizers and classifiers. From this point of view, the kneaded mixture has to be so brittle as to be pulverized. Therefore, the color powder, which is prepared by pulverizing a kneaded mixture, tends to have a broad particle diameter distribution. In order to prepare toner images having good resolution and half tone properties, the color powder has to be classified so as to have a particle diameter of from 5 to 20 $\mu$m. Therefore the toner yield is very low in the classification process.

In addition, it is impossible to uniformly disperse a colorant and a charge controlling agent in a thermoplastic resin when the pulverization methods are used. Uneven dispersion of toner constituents adversely affects the fluidity, developing properties, durability and image qualities of the resultant toner.

In attempting to solve such problems, suspension polymerization methods have been proposed and practically used now. The techniques for manufacturing a toner utilizing a polymerization method are known.

However, the particles of toners prepared by suspension polymerization methods have a spherical form and therefore the toners have a drawback of having a poor cleaning property. When toner images have a low image area share (i.e., the percentage of the area of a toner image in a copy sheet is low), the amount of the toner particles remaining on a photoreceptor is small, and therefore a cleaning problem hardly occurs. However, when toner images have a high image area share (for example, copies of photograph images) are produced or when a toner image remains on a photoreceptor without being transferred to a receiving material due to paper jamming problems or the like, a large amount of the toner particles remains on the photoreceptor, resulting in occurrence of background fouling in the resultant or following images. In this case, when a contact charging roller is used, the toner particles remaining on the photoreceptor contaminate the charging roller, resulting in deterioration of the charging ability of the charging roller.

In attempting to solve such a problem, Japanese Patent No. 2,537,503 (i.e., published Japanese Patent Application No. 63-186253) discloses a method in which resin particles prepared by an emulsion polymerization method are associated to prepare toner particles having an irregular form. However, the toner particles prepared by such an emulsion polymerization method include a large amount of a surfactant on or in the toner particles even after the toner particles are washed with water. Therefore, the resultant toner has poor charge stability when environmental conditions change and in addition the distribution of the charge quantity of the toner particles is broad, thereby causing background fouling in copy images. In addition, the remaining surfactant contaminates the photoreceptor and charging roller, developing roller and the like elements used in image forming apparatus, resulting in deterioration of the abilities of the elements.

In contrast, when a contact heating method using a heating member such as heat rollers is used for the fixing process, the toner particles preferably have a releasability from heating members (this releasability is hereinafter referred to as an offset resistance). The offset resistance of a toner can be improved by including a release agent to the toner such that the release agent is present on the surface of the toner. Published Japanese Patent Applications Nos. 2000-292973 and 2000-292978 disclose a method of improving the offset resistance in which resin particles are not only present in the toner particles but also unevenly present on the surface of the toner particles. However, this method has a drawback in that the lower limit of the fixing temperature range increases, namely the toner has poor low temperature fixability, i.e., energy saving is not satisfactory in the fixing process.

The methods in which toner particles having irregular forms are prepared by associating resin particles prepared by an emulsion polymerization method have the following drawbacks.

When particles of a release agent are associated to improve the offset resistance of the toner, the release agent particles are included inside the toner particles, and thereby the offset resistance of the toner cannot be improved. In addition, since resin particles, release agent particles and colorant particles are randomly mixed and fused to prepare toner particles, the formula of the toner particles varies (i.e., contents of the toner constituents in the toner particles vary) and in addition the molecular weight of the binder resin varies in the toner particles. As a result, each toner particle has different surface properties, and therefore the toner cannot stably produce images having good image qualities for a long period of time. Further, in an image forming system which requires the toner to have a low temperature fixability, a poor fixing problem occurs due to the toner particles on the surface of which the resin particles are unevenly present, and therefore the toner cannot be used therefor because of having a narrow fixing temperature range.

In attempting to control the particle diameter distribution of a toner so as to be sharp, a method having the following steps is proposed:

(1) toner constituents including a binder resin are dissolved or dispersed in a solvent to prepare a solution or dispersion thereof;

(2) the solution or dispersion is added to an aqueous medium including resin particles and a crosslinking agent and/or an elongation agent to react the binder resin with the crosslinking agent and/or elongation agent; and (3) the solvents are removed from the resultant dispersion to prepare toner particles.

In this case, whether the resin particles are present in the aqueous medium largely influences on the particle diameter distribution.

Published Japanese Patent Application No. 8-254853 discloses a capsule toner in which resin particles are fixed on the surface of a toner core material. However, when the toner is fixed, exudation of the wax included in the capsule toner from the surface thereof is prevented by the resin particles present on the surface, resulting in deterioration of fixing properties of the toner. In addition, since the resin particles are not used for controlling the particle diameter of the toner, the capsule toner does not have a sharp particle diameter distribution.

As mentioned above, there is no toner which can produce high quality images and which has good fixing properties.

SUMMARY OF THE INVENTION

Accordingly, an object of the present invention is to provide a toner which has a good combination of fine dot reproducibility, low temperature fixability and offset resistance and which does not contaminate the image forming members used, such as fixing devices and image bearing members.

Another object of the present invention is to provide a toner which has sharp charge quantity distribution and which can produce sharp images for a long period of time.

Yet another object of the present invention is to provide a toner which can maintain good cleaning properties for a long period of time.

A further object of the present invention is to provide a developer using the toner of the present invention.

A still further object of the present invention is to provide a developing method using the toner of the present invention.

A still further object of the present invention is to provide a toner container containing the toner of the present invention.

Briefly these objects and other objects of the present invention as hereinafter will become more readily apparent can be attained by toner particles including a binder resin, a colorant and resin particles which are present at least on a portion of the surface of the toner particles and which have a glass transition temperature of from 50 to 90° C., wherein a ratio (Dv/Dn) of a) the volume average particle diameter (Dv) of b) the toner to the number average particle diameter (Dn) thereof is from 1.00 to 1.40, and wherein a covering ratio of 1) the area of the surface of the toner particles which are covered by the particulate resin to 2) the total area of the surface is from 1 to 90%.

It is preferable that the ratio (Dv/Dn) is from 1.00 to 1.20, the glass transition temperature of the resin particles is from 50 to 70° C., and the covering ratio is from 5 to 80%.

The binder resin preferably includes a polyester resin, and more preferably a modified polyester resin and an unmodified polyester resin, wherein the weight ratio of the modified polyester resin to the unmodified polyester resin is from 5/95 to 80/20.

The binder resin preferably has an acid value of from 1 to 30 mgKOH/g.

The binder resin preferably has a glass transition temperature of from 50 to 70° C.

The resin particles preferably include a resin selected from the group consisting of vinyl resins, polyurethane resins, epoxy resins and polyester resins.

The resin particles preferably have an average particle diameter of from 5 to 200 nm and a weight average molecular weight not greater than 100,000.

The toner particles preferably have a volume average particle diameter of from 4 to 8 $\mu$m.

The toner particles preferably have a spherical degree of from 0.94 to 0.96.

The resin particles are preferably present on the surface of the toner particles in an amount not greater than 2.5% by weight based on total weight of the toner particles (i.e., the remaining ratio of the resin particles is not greater than 2.5% by weight).

The toner particles optionally further include an external additive on the surface thereof.

In another aspect of the present invention, a method for manufacturing a toner is provided which includes the steps of:

dissolving or dispersing toner constituents including at least a modified polyester resin capable of reacting with an active hydrogen in an organic solvent to prepare a solution or a dispersion;

dispersing the solution or dispersion in an aqueous liquid including resin particles and at least one of a crosslinking agent and an elongation agent to react the modified polyester resin with the crosslinking agent and/or an elongation agent and to prepare an aqueous dispersion;

removing the solvents from the aqueous dispersion to prepare particles; and washing the particles to remove the resin particles present on the surface of the particles, resulting in formation of the toner on which the resin particles are unevenly present.

The solvent removing step is preferably performed under a reduced pressure condition or upon application of heat thereto. Alternatively, the solvent removing step may be performed by filtering.

In yet another aspect of the present invention, a developer including a toner including toner particles of the present invention and a carrier is provided.

In a further aspect of the present invention, an image forming method is provided which includes the steps of:

developing an electrostatic latent image on an image bearing member with a developer including a toner to form a toner image;

transferring the toner image onto a receiving material;

collecting a toner remaining on the surface of the image bearing member; and returning the collected toner to the developer, wherein the toner includes the toner particles of the present invention.

In a still further aspect of the present invention, a toner container containing the toner particles of the present invention is provided.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
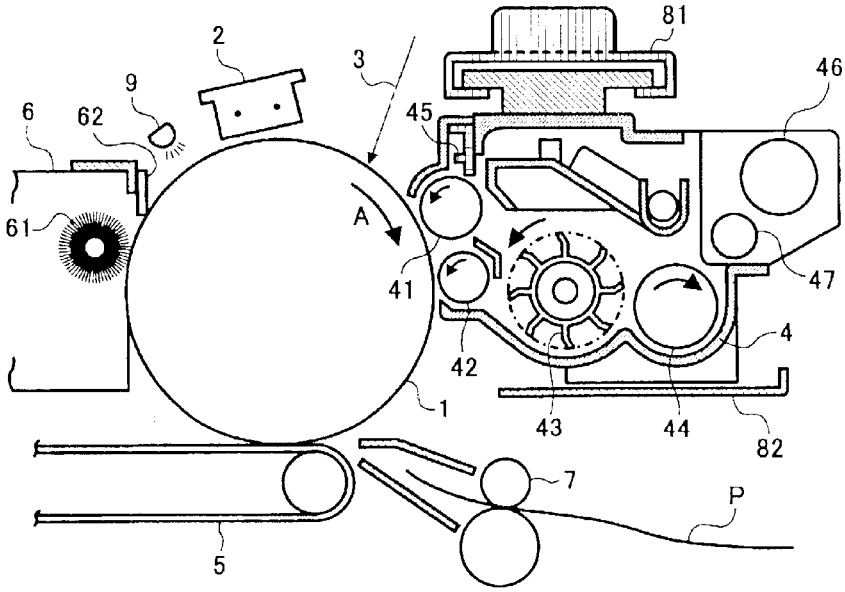
FIG. 1 is a schematic view illustrating a main portion of an embodiment of the developing device of the present invention.

At first, the physical properties and main toner constituents used in the present invention will be explained in detail.

Ratio (Dv/Dn)

The ratio (Dv/Dn) (volume average particle diameter/number average particle diameter) will be explained in detail.

The volume average particle diameter (Dv) of the toner of the present invention is from 4 to 8 μm, and the ratio of Dv/Dn of the volume average particle diameter (Dv) to the number average particle diameter (Dn) is not greater than 1.40, preferably not greater than 1.20, and more preferably from 1.00 to 1.20. When such a toner is used for a two component developer while a cyclic operation of consumption and replenishment of the toner is frequently performed, the particle diameter of the toner particles in the two component developer hardly changes, and thereby stable development can be performed (i.e., good images can be stably produced) for a long period of time even if the toner is agitated in the developing device.

In addition, when the toner is used as a one component developer, the toner does not cause problems such that a toner film is formed on the developing roller used and the toner adheres to a member such as blades configured to regulate the toner to form a thin toner layer. Therefore, even when the toner is used for a long period of time in a developing device while agitated, stably development can be performed and good images can be stably produced.

In general, the smaller particle diameter a toner has, the better the image qualities of the resultant toner images. However, the smaller particle diameter a toner has, the worse transferability and cleaning property the toner has. When the toner has a volume average particle diameter less than 4 μm, the toner tends to adhere to the surface of the carrier included in a two component developer if the developer is agitated for a long period of time, resulting in deterioration of the charging ability of the carrier. When such a small toner is used as a one component developer, the toner tends to cause problems such that a toner film is formed on the developing roller used and the toner adheres to a member such as blades configured to regulate the toner to form a thin toner layer. The same is true for the case in which the toner includes a large amount of fine toner particles.

In contrast, when the volume average particle diameter of the toner is greater than 8 μm, it is hard to produce high resolution and high quality images and in addition the particle diameter of the toner largely changes if a cyclic operation of consumption and replenishment is repeatedly performed. The same is true for the case in which the ratio Dv/Dn is greater than 1.40.

It is preferable that the ratio Dv/Dn approaches 1.00, because the resultant toner particles have uniform performance and the charge quantity thereof is uniform, and thereby high quality images can be stably produced.

Resin Particles

The resin particles for use in the toner of the present invention preferably have a glass transition temperature of from 50 to 90° C. When the glass transition temperature is lower than 50° C., the preservability of the toner tends to deteriorate and a blocking problem in that the toner aggregates in a developing device often occurs. When the glass transition temperature is higher than 90° C., the resin particles tend to prevent the toner from adhering to a receiving material, thereby causing problems in that the fixing temperature has to be increased, a wide fixing temperature range cannot be obtained, and the toner cannot be used for image forming apparatus using a low temperature fixing device, often occur. In addition, another problem in that when the fixed toner image is rubbed, the toner image is easily released from the receiving material often occurs.

The resin particles preferably have a weight average molecular weight not greater than 100,000, and more preferably from 4,000 to 50,000. When the weight average molecular weight is too high, the resin particles prevent the toner from adhering to a receiving material, and thereby causing a problem in that the fixing temperature has to be increased.

Suitable resins for use as the resin particles include any known resins which can form an aqueous dispersion. Specific examples of the resins include thermoplastic resins and thermosetting resins such as vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination.

Among these resins, vinyl resins, polyurethane resins, epoxy resins, polyester resins, and mixtures thereof are preferably used because an aqueous dispersion including fine particles can be easily prepared.

Specific examples of the vinyl resins include polymers, which are prepared by polymerizing a vinyl monomer or copolymerizing vinyl monomers, such as styrene-(meth) acrylate resins, styrene-butadiene copolymers, (meth)acrylic acid-acrylate copolymers, styrene-acrylonitrile copolymers, styrene-maleic anhydride copolymers and styrene-(meth) acrylic acid copolymers.

The resin particles preferably have an average particle diameter of from 5 to 200 nm, and more preferably from 20 to 180 nm.

Covering Ratio

In the present invention, the resin particles are added in the manufacturing process of the toner to control the formal properties of the toner such as spherical degree and particle diameter distribution. The resin particles are mainly and unevenly present on the surface of the toner particles. It is important that the resin particles have a glass transition temperature (Tg) of from 50 to 90° C. and the covering ratio (i e., the ratio of the area of the surface of toner particles covered by the resin particles to the total areas of the surface) is from 1 to 90%.

When the covering ratio is greater than 90%, the surface of the toner particles is almost perfectly covered with the resin particles, and the resin particles tend to prevent a release agent such as waxes included in the toner particles from exuding therefrom. Thereby the releasing effect cannot be obtained, resulting in occurrence of the offset problem. In contrast, when the covering ratio is less than 1%, the resin particles cannot impart good frictional charging properties to the toner, and thereby the resultant toner has low charge quantity. Therefore the resultant images have low image density and background fouling, and the toner tends to scatter in the developing section, resulting in contamination of the various members used in the image forming apparatus. The covering ratio is preferably from 5 to 80%.

The covering ratio is determined by photographing the surface of particles of a toner using an electron microscope and then analyzing the photograph with an image analyzer. The measuring method is mentioned below.

Remaining Ratio of Resin Particles

The resin particles are added to the toner to adjust the spherical degree of the toner. It is important that the remaining ratio of the resin particles which are unevenly present on the surface of the toner particles is preferably not greater than 2.5%. The remaining ratio is defined as follows:

$$\text{Remaining ratio}=(A/B)\times 100\ (\%)$$

wherein A represents the weight of the resin particles remaining on the surface of the toner particles and B represents the weight of the toner particles.

When the remaining ratio is greater than 2.5%, the resin particles prevent the toner from adhering to a receiving material, thereby causing problems in that the fixing temperature has to be increased, a wide fixing temperature range cannot be obtained, and the toner cannot be used for image forming apparatus using a low temperature fixing device. In addition, another problem in that the fixed toner image is rubbed, the toner image is easily released from the receiving material occurs. Further, the resin particles deteriorate the friction charging properties of the toner, and thereby the toner has low charge quantity, resulting occurrence of problems in that the toner scatters in the developing device, resulting in contamination of image bearing members and other members, and the resultant toner images have background fouling.

The remaining ratio can be determined by analyzing the weight of a decomposition product, which is produced by decomposing the resin particles, but which is not produced by decomposing the toner particles, using pyrolysis gas chromatography and calculating the area of the peak thereof.

Spherical Degree

Then the spherical degree and spherical degree distribution will be explained.

It is important for the toner of the present invention to have a specific spherical degree and a specific spherical degree distribution. When the toner has an average spherical degree less than 0.94, i.e., the toner has a form largely different from a spherical form, high quality images cannot be produced (for example, transferability deteriorates and the resultant images have background fogging).

In the present invention, the spherical degree of a toner is measured as follows:

(1) a suspension including particles (i.e., a toner) to be measured is passed through a detection area formed on a plate in the measuring instrument (a flow-type particle image analyzer); and (2) the particles are optically observed by a CCD camera to analyze the shapes thereof.

The spherical degree of a particle is determined by the following equation:

$$\text{Spherical degree}=Cs/Cp$$

wherein Cp represents the length of the circumference of the projected image of a particle and Cs represents the length of the circumference of a circle having the same area as that of the projected image of the particle.

When the average spherical degree is from 0.94 to 0.96, the resultant toner can stably produce high quality images having a proper image density and a high resolution. It is more preferable for the toner of the present invention to have an average spherical degree of from 0.945 to 0.955. In addition, in the toner of the present invention the content of the toner particles having a spherical degree less than 0.94 is not greater than 10%.

When the average spherical degree is greater than 0.96, the toner particles remaining on an image bearing member such as photoreceptors cannot be fully removed, resulting in formation of background fouling in the resultant toner images. When images having small image area are developed or transferred, the amount of residual toner (i.e., toner remaining on an image bearing member) is little, and therefore the above-mentioned cleaning problem hardly occurs. However, when images having large image area such as color images are formed or toner images formed on an image bearing member are not transferred on a receiving material due to an accident such as mis-feeding of a receiving material, the amount of the residual toner increases. When the residual toner accumulates on the image bearing member, a background fouling problem occurs. In addition, when a contact charger such as charging roller is used, the residual toner contaminates the contact charger, and thereby the charging ability of the charger deteriorates.

In the present invention, the spherical degree and average spherical degree are measured by a flow-type particle image analyzer FPIA-2100 manufactured by SYSMEX CORPORATION. The specific measuring method will be explained later.

Binder Resin

Suitable binder resins for use in the toner of the present invention include known resins. Resins such as polyester resins, styrene resins, acrylic resins and epoxy resins have been typically used as the binder resin of conventional toners. Among these resins, styrene-acrylate copolymers have been most popularly used for conventional toners.

Polyester resins are popularly used for toners having low temperature fixability. Because of having a relatively low softening point while having a relatively high glass transition temperature, and polyester resins have a good combination of low temperature fixability and preservation stability. In addition, the ester bonding of polyester resins has good affinity for receiving papers, and thereby hardly causing offset problems.

The toner of the present invention includes a polyester resin as a main binder. This polyester resin is prepared by a condensation reaction of an acid component with an alcohol component, a ring-opening reaction of a ring ester or a reaction of a halogen compound with an alcohol component and carbon oxide.

The toner of the present invention is typically prepared by a method in which the above-mentioned monomers for a polyester resin are polymerized in a solution of one or more of the polymers mentioned above. By using this method, the toner of the present invention which has the good physical properties mentioned above can be easily prepared.

Hereinafter, constituents (monomers) of the polyester resins for use in the toner of the present invention will be explained in detail.

Suitable alcohol components include diols and polyols. Specific examples of diols include diols such as ethylene glycol, triethylene glycol, 1,2-propylene glycol, 1,3-propylene glycol, 1,4-butanediol, neopentyl glycol, 1,4-butenediol, 1,5-pentanediol and 1,6-hexanediol; adducts of bisphenol A with an alkylene oxide, such as bisphenol A, hydrogenated bisphenol A, α, α'-bis(4-hydroxyphenyl)-1,4-diisopropylbenzene, polyoxyethylenated bisphenol A and polyoxypropylenated bisphenol A; etc.

Specific examples of the polyhydric alcohols include sorbitol, 1,2,3,6-hexanetetrol, 1,4-sorbitane, pentaerythritol, sucrose, 1,2,4-butanetriol, 1,2,5-pentanetriol, glycerol, 2-methylpropanetriol, 2-metyl-1,2,4-butanetriol, trimethylol methane, trimethylol ethan, trimethylol propane, 1,3,5-trihydroxymethyl benzene, etc.

Suitable acid components include dibasic or polybasic acids.

Specific examples of the dibasic acids include divasic organic acids such as maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, and other dibasic organic acids. Specific examples of tribasic acids include 1,2,4-benzene tricarboxylic acid, 1,2,5-benzene tricarboxylic acid, 1,2,4-cyclohexane tricarboxylic acid, 2,5,7-naphthalene tricarboxylic acid, 1,2,5-naphthalene tricarboxylic acid, 1,2,5-hexane tricarboxylic acid, 1,3-dicarboxyl-2-methyl-2-carboxymethyl propane, tetra (carboxymethyl) methane, 1,2,7,8-octane tetracarboxylic acid, etc. Anhyderides and halogenated compounds of these acids can also be used as the acid component.

Halogenated compounds can also be used as the acid component. Specific examples of such halogenated compounds include polyhalogenated compounds such as cis-1,2-dichloroethene, trans-1,2-dichloroethene, 1,2-dichloropropene, 2,3-dichloropropene, 1,3-dicholorpropene, o-dichlotobenzene, m-dichlorobenzene, p-dichlorobenzene, o-dibromobenzene, m-dibromobenzene, p-dibromobenzene, o-chlorobromobenzene, dichlorocyclohexane, dichloroethane, 1,4-dichlorobutane, 1,8-dichlorooctane, 1,7-dichlorooctane, dichloromethane, 4,4'-dibromovinylphenol, 1,2,4-tribrombenzene, etc.

The alcohol component or acid component used for preparing the polyester resins for use as the binder resin of the toner of the present invention preferably includes an aromatic ring. In addition, it is preferable the total quantity of the alcohol component and acid component is from 1 to 30 parts by weight, and preferably from 1.5 to 10 parts by weight, per 1 part by weight of the polymer compound mentioned above.

The molar ratio [COOH]/[OH] of the acid component to the alcohol component is preferably from 0.9 to 1.5 and more preferably from 1.0 to 1.3. When a halogenated compound is used, the content of [COOH] should be replaced with the halogen content.

When the polyester resins are synthesized, additives such as amines and condensing agents can be used. Specific examples of such amines include triethylamine, trimethylamine, N,N-dimethylaniline, etc. Specific examples of the condensing agents include dicyclohexylcarbodiimide, etc.

The toner of the present invention is preferably prepared by the following method:

(1) a modified polyester resin reactive with an active hydrogen, a colorant and a release agent are dispersed in an aqueous medium in the presence of a dispersant to prepare a dispersion;

(2) the dispersion is reacted with a crosslinking agent and an elongation agent; and (3) the solvent is removed from the dispersion including a reaction product.

Hereinafter this toner will be explained in detail.

At first, the modified polyester resin for use in the toner of the present invention will be explained.

Modified Polyester Resin Reactive with Active Hydrogen

Suitable reactive modified polyester resins (RMPE) for use in the toner of the present invention, which can react with an active hydrogen, include polyester prepolymers having a functional group, which can react with an active hydrogen, such as an isocyanate group. Suitable polyester prepolymers for use in the toner of the present invention include polyester prepolymer (A) having an isocyanate group.

The polyester prepolymer (A) having an isocyanate group can be prepared by reacting an isocyanate compound (PIC) with a polyester which is a polycondensation product of a polyol (PO) and a polycarboxylic acid (PC) and which has a group having an active hydrogen. Suitable groups having an active hydrogen include a hydroxyl group (an alcoholic hydroxyl group and a phenolic hydroxyl group), an amino group, a carboxyl group, a mercapto group, etc. Among these groups, the amino group is preferable.

The reactive modified polyester resins are reacted with a crosslinking agent and/or an elongation agent in an aqueous medium. As the crosslinking agent and elongation agent, amines including an amino group are preferably used.

Suitable polyols (PO) include diols (DIO) and polyols (TO) having three or more hydroxyl groups. It is preferable to use a DIO alone or mixtures in which a small amount of a TO is mixed with a DIO.

Specific examples of the diols (DIO) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); adducts of the bisphenols mentioned above with an alkylene oxide (e.g., ethylene oxide, propylene oxide and butylene oxide); etc.

Among these compounds, alkylene glycols having from 2 to 12 carbon atoms and adducts of a bisphenol with an alkylene oxide are preferable. More preferably, adducts of a bisphenol with an alkylene oxide, or mixtures of an adduct of a bisphenol with an alkylene oxide and an alkylene glycol having from 2 to 12 carbon atoms are used.

Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids (PC) include dicarboxylic acids (DIC) and polycarboxylic acids (TC) having three or more carboxyl groups. It is preferable to use dicarboxylic acids (DIC) alone or mixtures in which a small amount of a TC is mixed with a DIC.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

As the polycarboxylic acid (TC), anhydrides or lower alkyl esters (e.g., methyl esters, ethyl esters or isopropyl esters) of the polycarboxylic acids mentioned above can be used for the reaction with a polyol.

Suitable mixing ratio (i.e., an equivalence ratio [OH]/[COOH]) of a polyol (PO) to a polycarboxylic acid (PC) is from 2/1 to 1/1, preferably from 1.5/1 to 1/1 and more preferably from 1.3/1 to 1.02/1.

Specific examples of the polyisocyanates (PIC) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic didicosycantes (e.g., tolylene diisocyanate and diphenylmethane diisocyanate); aromatic aliphatic diisocyanates (e.g., $\alpha$, $\alpha$, $\alpha'$, $\alpha'$-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., [NCO]/[OH]) of a polyisocyanate (PIC) to a polyester having a hydroxyl group is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases and thereby the hot offset resistance of the toner deteriorates. The content of the constitutional component of a polyisocyanate (PIC) in the polyester prepolymer (A) having a polyisocyanate group at its end portion is from 0.5 to 40% by weight, preferably from 1 to 30% by weight and more preferably from 2 to 20% by weight. When the content is too low, the hot offset resistance of the toner deteriorates and in addition the heat resistance and low temperature fixability of the toner also deteriorate. In contrast, when the content is too high, the low temperature fixability of the toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is too small (less than 1 per 1 molecule), the molecular weight of the resultant urea-modified polyester decreases and thereby the hot offset resistance deteriorates.

By reacting the polyester prepolymer (A) having an isocyanate group with an amine (B), a urea-modified polyester resin (UMPE) can be prepared. This UMPE can be preferably used as the toner binder.

Specific examples of the amines (B) include diamines (B1) polyamines (B2) having three or more amino groups, amino alcohols (B3), amino mercaptans (B4), amino acids (B5) and blocked amines (B6) in which the amines (B1–B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines B1–B5 mentioned above with a ketone such as acetone, methyl ethyl ketone and methyl isobutyl ketone; oxazoline compounds, etc. Among these compounds, diamines (B1) and mixtures in which a diamine (B1) is mixed with a small amount of a polyamine (B2) are preferable.

The molecular weight of the urea-modified polyesters can be controlled using an elongation anticatalyst, if desired. Specific examples of the elongation anticatalyst include monoamines (e.g., diethyle amine, dibutyl amine, butyl amine and lauryl amine), and blocked amines (i.e., ketimine compounds) prepared by blocking the monoamines mentioned above.

The mixing ratio (i.e., a ratio [NCO]/[NHx]) of the prepolymer (A) having an isocyanate group to the amine (B) is from 1/2 to 2/1, preferably from 1.5/1 to 1/1.5 and more preferably from 1.2/1 to 1/1.2. When the mixing ratio is too low or too high, the molecular weight of the resultant urea-modified polyester decreases, resulting in deterioration of the hot offset resistance of the resultant toner.

The urea-modified polyesters may include a urethane bonding together with a urea bonding. The molar ratio (urea/urethane) of the urea bonding to the urethane bonding is from 100/0 to 10/90, preferably from 80/20 to 20/80 and more preferably from 60/40 to 30/70. When the content of the urea bonding is too low, the hot offset resistance of the resultant toner deteriorates.

The urea-modified polyesters (UMPE) for use in the toner of the present invention can be prepared, for example, by a method such as one-shot methods or prepolymer methods. The weight average molecular weight of the modified polyesters such as urea-modified polyesters is not less than 10,000, preferably from 20,000 to 10,000,000 and more preferably from 30,000 to 1,000,000. When the weight average molecular weight is too low, the hot offset resistance of the resultant toner deteriorates. The number average molecular weight of the urea-modified polyesters is not particularly limited (i.e., the weight average molecular weight should be primarily controlled so as to be in the range mentioned above) when an unmodified polyester resin which is not modified and which is mentioned below is used in combination. Namely, controlling of the weight average molecular weight of the urea-modified polyester resins has priority over controlling of the number average molecular weight thereof. However, when a urea-modified polyester is used alone, the number average molecular weight is not greater than 20,000, preferably from 1,000 to 10,000, and more preferably from 2,000 to 8,000. When the number average molecular weight is too high, the low temperature fixability of the resultant toner deteriorates, and in addition the gloss of full color images decreases.

Unmodified Polyester

Then the unmodified polyester resin for use in the toner of the present invention will be explained.

In the toner of the present invention, the modified polyester resins (MPE) such as urea-modified polyester resins (UMPE) can be used alone or in combination with unmodified polyester resins (PE) as the binder resin of the toner. By using a combination of a urea-modified polyester resin (UMPE) with an unmodified polyester resin (PE), the low temperature fixability of the toner can be improved and in addition the toner can produce color images having a high gloss.

Suitable unmodified polyester resins (PE) include polycondensation products of a polyol with a polycarboxylic acid. Specific examples of the polyol and polycarboxylic acid are mentioned above for use in the modified polyester resins (MPE). In addition, specific examples of the suitable polyol and polycarboxylic acid are also mentioned above.

In addition, as the unmodified polyester resins, polyester resins modified by a bonding (such as urethane bonding) other than a urea bonding, can also be used as well as the unmodified polyester resins mentioned above.

When a mixture of a modified polyester resin (MPE) with an unmodified polyester resin (PE) is used as the binder resin, it is preferable that the modified polyester resin (MPE) at least partially mixes with the unmodified polyester resin (PE) to improve the low temperature fixability and hot offset resistance of the toner. Namely, it is preferable that the modified polyester resin (MPE) has a structure similar to that of the unmodified polyester resin (PE). The mixing ratio (MPE/PE) of a modified polyester resin (MPE) to an unmodified polyester resin (PE) is from 5/95 to 80/20, preferably from 5/95 to 30/70, more preferably from 5/95 to 25/75, and even more preferably from 7/93 to 20/80. When the addition amount of the modified polyester resin (MPE) is too small, the hot offset resistance of the toner deteriorates and in addition, it is impossible to achieve a good combination of high temperature preservability and low temperature fixability.

The peak molecular weight of the unmodified polyester resins (PE) is from 1,000 to 30,000, preferably from 1,500 to 10,000 and more preferably from 2,000 to 8,000. When the peak molecular weight is too low, the low temperature fixability deteriorates.

It is preferable for the unmodified polyester resins (PE) to have a hydroxyl value not less than 5, preferably from 10 to 120 and more preferably from 20 to 80. When the hydroxyl value is too low, it is impossible to achieve a good combination of high temperature preservability and low temperature fixability.

It is preferable for the unmodified polyester resins (PE) to have an acid value of from 1 to 30 mgKOH/g, and more preferably from 5 to 20 mgKOH/g.

In the present invention, the binder resin preferably has a glass transition temperature (Tg) of from 50 to 70° C., and preferably from 55 to 65° C. When the glass transition temperature is too low, the high temperature preservability of the toner deteriorates. In contrast, when the glass transition temperature is too high, the low temperature fixability deteriorates.

When a urea-modified polyester resin is used in combination with an unmodified polyester resin as the binder resin, the resultant toner has better high temperature preservability than conventional toners including a polyester resin as a binder resin even if the urea-modified polyester resin has a relatively low glass transition temperature compared to the polyester resin included in conventional toners.

With respect to the storage modulus of the toner binder for use in the toner of the present invention, the temperature (TG') at which the storage modulus is 10,000 dyne/cm$^2$ when measured at a frequency of 20 Hz is not lower than 100° C., and preferably from 110 to 200° C.

With respect to the viscosity of the toner binder, the temperature (Tη) at which the viscosity is 1,000 poise when measured at a frequency of 20 Hz is not higher than 180° C., and preferably from 90 to 160° C. When the temperature (Tη) is too high, the low temperature fixability of the toner deteriorates. In order to achieve a good combination of low temperature fixability and hot offset resistance, it is preferable that the TG' is higher than the Tη. Specifically, the difference (TG'−Tη) is preferably not less than 0, preferably not less than 10° C. and more preferably not less than 20° C. The difference particularly has an upper limit. In order to achieve a good combination of high temperature preservability and low temperature fixability, the difference (TG'−Tη) is preferably from 0 to 100° C., more preferably from 10 to 90° C. and even more preferably from 20 to 80° C.

Colorant

Suitable colorants for use in the toner of the present invention include known dyes and pigments. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight, based on total weight of the toner.

Master batch pigments, which are prepared by combining a colorant with a resin, can be used as the colorant of the toner composition of the present invention. Specific examples of the resins for use in the master batch pigments or for use in combination with master batch pigments include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batch for use in the toner of the present invention is typically prepared by mixing and kneading a resin and a colorant upon application of high shear stress thereto. In this case, an organic solvent can be used to heighten the interaction of the colorant with the resin. In addition, flushing methods in which an aqueous paste including a colorant is mixed with a resin solution of an organic solvent to transfer the colorant to the resin solution and then the aqueous liquid and organic solvent are separated to be removed can be preferably used because the resultant wet cake of the colorant can be used as it is. In this case, three-roll mills can be preferably used for kneading the mixture upon application of high shear stress thereto.

Release Agent

A release agent may be included in the toner of the present invention. Suitable release agents include known waxes.

Specific examples of the release agent include polyolefin waxes such as polyethylene waxes and polypropylene waxes; long chain hydrocarbons such as paraffin waxes and SAZOL waxes; waxes including a carbonyl group, etc. Among these waxes, the waxes including a carbonyl group are preferably used.

Specific examples of the waxes including a carbonyl group include polyalkane acid esters such as carnauba wax, montan waxes, trimethylolpropane tribehenate, pentaerythritol tetrabehenate, pentaerythritol diacetate dibehenate, glycerin tribehenate, and 1,18-octadecanediol distearate; polyalkanol esters such as trimellitic acid tristearyl, and distearyl maleate; polyalkylamide such as trimellitic acid tristearylamide; dialkyl ketone such as distearyl ketone, etc. Among these materials, polyalkane acid esters are preferable.

The waxes for use in the toner of the present invention preferably have a melting point of from 40 to 160° C., more preferably from 50 to 120° C., and even more preferably from 60 to 90° C. When the melting point of the wax included in the toner is too low, the high temperature preservability of the toner deteriorates. In contrast, when the melting point is too high, a cold offset problem in that an offset phenomenon occurs at a low fixing temperature tends to occur.

The wax used in the toner of the present invention preferably has a melt viscosity of from 5 to 1000 cps and more preferably from 10 to 100 cps at a temperature 20° C. higher than the melting point of the wax. When the melt viscosity is too high, the effect of improving the hot offset resistance and low temperature fixability is lessened. The content of the wax in the toner is from 0 to 40% by weight and preferably from 3 to 30% by weight based on total weight of the toner.

Charge Controlling Agent

A charge controlling agent may be included in the toner of the present invention.

Specific examples of the charge controlling agent include known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc.

Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid) E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images.

The charge controlling agent can be dissolved or dispersed in an organic solvent after kneaded together with a master batch pigment and resin. In addition, the charge controlling agent can be directly dissolved or dispersed in an organic solvent when the toner constituents are dissolved or dispersed in an organic solvent. Alternatively, the charge controlling agent may be fixed on the surface of the toner particles after the toner particles are prepared.

External Additive

The thus prepared toner particles may be mixed with an external additive to assist in improving the fluidity, developing property and charging ability of the toner particles. Suitable external additives include particulate inorganic materials. It is preferable for the particulate inorganic materials to have a primary particle diameter of from 5 nm to 2 μm, and more preferably from 5 nm to 500 nm. In addition, it is preferable that the specific surface area of such particulate inorganic materials measured by a BET method is from 20 to 500 $m^2/g$. The content of the external additive is preferably from 0.01 to 5% by weight, and more preferably from 0.01 to 2.0% by weight, based on total weight of the toner.

Specific examples of such inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromiumoxide, cerium oxide, red iron oxide, antimony trioxide, magnesium oxide, zirconium oxide, barium sulfate, barium carbonate, calcium carbonate, silicon carbide, silicon nitride, etc.

In addition, particles of polymers such as polymers and copolymers of styrene, methacrylates, acrylates or the like; polymers prepared by polycondensation polymerization, such as silicone resins, benzoguanamine resins and nylon resins; and thermosetting resins, which can be prepared by a soap-free emulsion polymerization method, a suspension polymerization method or a dispersion method, can also be used as the external additive.

These materials for use as the external additive can be subjected to a surface treatment to be hydrophobized, thereby preventing the fluidity and charge properties of the toner even under high humidity conditions. Specific examples of the hydrophobizing agents include silane coupling agents, silylation agents, silane coupling agents including a fluoroalkyl group, organic titanate coupling agents, aluminum coupling agents, silicone oils, modified silicone oils, etc.

The toner of the present invention may include a cleanability improving agent to improve the cleaning ability thereof such that the toner remaining on an image bearing member such as photoreceptors and intermediate transfer belts can be easily removed therefrom. Specific examples of the cleanability improving agents include fatty acids and metal salts thereof such as zinc stearate, calcium stearate and stearic acid; polymer particles which are prepared by a soap-free emulsion polymerization method or the like, such as polymethyl methacrylate particles and polystyrene particles; etc. The polymer particles preferably have a narrow particle diameter distribution and the volume average particle diameter thereof is preferably from 0.01 to 1 μm.

Method for Manufacturing Binder Resin

The binder resins (i.e., modified polyester resins and unmodified polyester resins) for use in the toner of the present invention are typically prepared by the following method.

A polyol and a polycarboxylic acid are heated to a temperature of from 150 to 280° C. in the presence of a known esterification catalyst such as tetrabutoxy titanate and dibutyltinoxide. Then water generated is removed, under a reduced pressure if desired, to prepare a polyester resin having a hydroxyl group.

Then the polyester resin is reacted with a polyisocyanate at a temperature of from 40 to 140° C. to prepare a prepolymer (A) having an isocyanate group. Further, the prepolymer (A) is reacted with an amine (B) at a temperature of from 0 to 140° C., to prepare a polyester resin modified by a urea bonding. When the polyester resin is reacted with the polyisocyanate and the prepolymer (A) is reacted with the amine (B), a solvent can be used if desired.

Suitable solvents include solvents which do not react with the polyisocyanate used. Specific examples of such solvents include aromatic solvents such as toluene and xylene; ketones such as acetone, methyl ethyl ketone and methyl isobutyl ketone; esters such as ethyl acetate; amides such as dimethylformamide and dimethylacetoaminde; ethers such as tetrahydrofuran; etc.

When an unmodified polyester resin, which does not have a urea bonding, is used in combination with the modified polyester resin, the unmodified polyester resin is prepared by a method similar to that used for preparing the polyester rein having a hydroxyl group, and the unmodified polyester resin is added to the solution of the modified polyester resin after the reaction of forming the modified polyester resin has completed.

Method for Manufacturing the Toner

The toner of the present invention can be manufactured by the following method, but the manufacturing method is not limited thereto.

Method for Manufacturing the Toner in Aqueous Medium

Suitable aqueous media for use in the toner manufacturing method of the present invention include water and mixtures of water with a solvent which can be mixed with water. Specific examples of such a solvent include alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc.

Toner particles can be prepared by reacting a dispersion, in which a prepolymer (A) having an isocyanate group is dispersed in an aqueous medium, with an amine (B).

In order to prepare a dispersion in which a urea-modified polyester resin or a prepolymer (A) is stably dispersed in an aqueous medium, a method, in which toner constituents including a urea-modified polyester or a prepolymer (A) are added into an aqueous medium and then dispersed upon application of shear stress, is preferably used.

A prepolymer (A) and other toner constituents such as colorants, master batch pigments, release agents, charge controlling agents, unmodified polyester resins, etc. may be added into an aqueous medium at the same time when the dispersion is prepared. However, it is preferable that the toner constituents are previously mixed and then the mixed toner constituents are added to the aqueous liquid at the same time to be dispersed. In addition, toner constituents such as colorants, release agents and charge controlling agents are not necessarily added to the aqueous dispersion before particles are formed, and may be added thereto after particles are prepared in the aqueous medium. For example, a method in which particles, which are previously formed without a colorant, are dyed by a known dying method can also be used.

The dispersion method is not particularly limited, and low speed shearing methods, high speed shearing methods, friction methods, high pressure jet methods, ultrasonic methods, etc. can be used. Among these methods, high speed shearing methods are preferable because particles having a particle diameter of from 2 μm to 20 μm can be easily prepared. At this point, the particle diameter (2 to 20 μm) means a particle diameter of particles including a liquid).

When a high speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C. When the temperature is relatively high, a urea-modified polyester or a prepolymer (A) can be easily dispersed because the dispersion has a low viscosity.

The weight ratio (T/M) of the toner constituents (T) (including a urea-modified polyester or a prepolymer (A)) to the aqueous medium (M) is typically from 100/50 to 100/2,000, and preferably from 100/100 to 100/1,000. When the ratio is too large (i.e., the quantity of the aqueous medium is small), the dispersion of the toner constituents in the aqueous medium is not satisfactory, and thereby the resultant toner particles do not have a desired particle diameter. In contrast, when the ratio is too small, the manufacturing costs increase.

A dispersant can be preferably used when the dispersion is prepared so that the dispersion includes particles having a sharp particle diameter distribution and the dispersion has good dispersion stability.

In the process in which a urea-modified polyester resin is synthesized from a prepolymer (A), an amine (B) can be added to an aqueous medium before toner constituents are dispersed therein, or added to a dispersion in which toner constituents are dispersed in an aqueous medium to be reacted with the prepolymer at the interface therebetween. In the latter case, the urea-modified polyester resin is preferentially formed at the surface portions of the toner particles. Thus, a gradient of the concentration of the urea-modified polyester resin can be formed in the thickness direction of the toner particles.

Specific examples of the dispersants which are used for dispersing or emulsifying an oil phase, in which toner constituents are dissolved or dispersed, in an aqueous liquid, include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi (aminoethyl)glycin, di)octylaminoethyle)glycin, and N-alkyl-N,N-dimethylammonium betaine.

By using a surfactant having a fluoroalkyl group, a dispersion having good dispersibility can be prepared even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkanoyl (C6–C11)oxy}-1-alkyl(C3–C4) sulfonate, sodium 3-{omega-fluoroalkanoyl(C6–C8)-N-ethylamino}-1-propanesulfonate, fluoroalkyl(C11–C20) carboxylic acids and their metal salts, perfluoroalkylcarboxylic acids and their metal salts, perfluoroalkyl(C4–C12)sulfonate and their metal salts, perfluorooctanesulfonic acid diethanol amides, N-propyl-N-(2-hydroxyethyl)perfluorooctanesulfone amide, perfluoroalkyl(C6–C10) sulfoneamidepropyltrimethylammonium salts, salts of perfluoroalkyl (C6–C10)-N-ethylsulfonyl glycin, monoperfluoroalkyl(C6–C16)ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNTDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can be used for dispersing an oil phase including toner constituents in water, include primary, secondary and tertiary aliphatic amines having a fluoroalkyl group, aliphatic quaternary ammonium salts such as perfluoroalkyl(C6–C10) sulfoneamidepropyltrimethylammonium salts, benzalkonium salts, benzetonium chloride, pyridinium salts, imidazolinium salts, etc. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.) ; MEGAFACE F-150 and F-824 (from Dainippon Ink and Chemicals, Inc.); ECTOP EF-132 (from Tohchem Products Co., Ltd.); FUTARGENT F-300 (from Neos); etc.

An inorganic compound which is hardly soluble in water, such as calcium phosphate, titanium oxide, colloidal silica, and hydroxyapatite can also be used as the dispersant.

Further, it is possible to stably disperse toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxypropyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds; acid chlorides (e.g., acrylic acid chloride and methacrylic acid chloride); and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When compounds such as calcium phosphate which are soluble in an acid or alkali are used as a dispersion stabilizer, it is preferable to dissolve calcium phosphate by adding an acid such as hydrochloric acid and to wash the resultant particles with water to remove calcium phosphate therefrom. In addition, such a dispersion stabilizer can be removed using a decomposition method using an enzyme.

When a dispersant is used, the resultant particles are preferably washed after the particles are subjected to an elongation and/or a crosslinking reaction to impart good charge ability to the resultant toner particles.

When an aqueous dispersion or emulsion is prepared, a solvent which can dissolve the urea-modified polyester (UMPE) or prepolymer (A) used is preferably used because the resultant particles have a sharp particle diameter distribution. The solvent is preferably volatile and has a boiling point lower than 100° C. because of being easily removed from the dispersion after the particles are formed.

Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used.

The addition quantity of such a solvent is from 0 to 300 parts by weight, preferably from 0 to 100, and more preferably from 25 to 70 parts by weight, per 100 parts by weight of the prepolymer (A) used. When such a solvent is used to prepare a particle dispersion, the solvent is removed therefrom upon application of heat thereto under a normal or reduced pressure condition after the particles are subjected to an elongation reaction and/or a crosslinking reaction.

When a modified polyester resin reactive with an active hydrogen is reacted with an amine (B) serving as a crosslinking agent and/or an elongation agent, the crosslinking time and/or the elongation time is determined depending on the reactivity of the isocyanate group of the prepolymer (A) with the amine (B) used, but in general the time is from 10 minutes to 40 hours, and preferably from 2 to 24 hours. The reaction temperature is generally from 0 to 150° C., and preferably from 40 to 98° C. In addition, a catalyst such as dibutyltin laurate and dioctyltin laurate can be optionally used for the reaction.

In order to remove the organic solvent from the thus prepared emulsion (dispersion), a drying method in which the temperature of the emulsion is gradually increased to evaporate the organic solvent from the drops dispersed in the emulsion can be used. Alternatively, a drying method in which the emulsion is sprayed in a dry atmosphere to dry not only the organic solvent in the drops in the emulsion but also the remaining aqueous medium. The dry atmosphere can be prepared by heating gases such as air, nitrogen, carbon dioxide and combustion gases. The temperature of the heated gases is preferably higher than the boiling point of the solvent having the highest boiling point among the solvents used in the emulsion. By using spray dryers, belt dryers, rotary kilns, etc., as a drying apparatus, the drying treatment can be completed in a short period of time.

When the thus prepared toner particles have a wide particle diameter distribution even after the particles are subjected to a washing treatment and a drying treatment, the toner particles are preferably subjected to a classification treatment so that the toner particles have a desired particle diameter distribution. The classification operation can be performed on a dispersion liquid using a cyclone, a decanter or a method utilizing centrifuge to remove fine particles therefrom. Of course, it is possible to classify the dried toner particles. However, it is preferable to subject the liquid including the particles to the classification treatment in view of efficiency. The toner particles having an undesired particle diameter can be reused as the raw materials for the kneading process. Such toner particles for reuse may be in a dry condition or a wet condition.

The dispersant used is preferably removed from the particle dispersion. The dispersant is preferably removed from the dispersion when the classification treatment is performed.

The thus prepared toner particles can be mixed with other particles such as release agents, charge controlling agents, fluidizing agents and colorants. Such particles can be fixed on the toner particles by applying mechanical impact thereto while the particles and toner particle can be integrated. Thus the particles can be prevented from being released from the toner particles.

Specific examples of such mechanical impact application methods include methods in which a mixture is mixed with a highly rotated blade and methods in which a mixture is put into a jet air to collide the particles against each other or a collision plate.

Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

The ratio (Dv/Dn) of the toner of the present invention can be controlled by optimizing the factors such as viscosity of the aqueous phase and oil phase, the physical properties and addition quantity of the resin particles and the like. In addition, Dv and Dn can be controlled by optimizing the factors such as the physical properties and addition quantity of the resin particles and the like.

Carrier for Use in Two-component Developer

The toner of the present invention can be used for a two-component developer in which the toner is mixed with a magnetic carrier. The weight ratio (T/C) of the toner (T) to the carrier (C) is preferably from 1/100 to 10/100.

Suitable carriers for use in the two component developer include known carrier materials such as iron powders, ferrite powders, magnetite powders, magnetic resin carriers, which have a particle diameter of from about 20 to about 200 $\mu$m. The surface of the carriers may be coated by a resin.

Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

If desired, an electroconductive powder may be included in the toner. Specific examples of such electroconductive powders include metal powders, carbon blacks, titanium oxide, tin oxide, and zinc oxide. The average particle diameter of such electroconductive powders is preferably not greater than 1 $\mu$m. When the particle diameter is too large, it is hard to control the resistance of the resultant toner.

The toner of the present invention can also be used as a one-component magnetic developer or a one-component non-magnetic developer.

As the developing method of the present invention, conventional developing methods can be used but the toner used therefor is the toner of the present invention.

As the developing apparatus of the present invention, conventional developing apparatuses can be used but the toner used therefor is the toner of the present invention.

Then the developing device and method of the present invention will be explained referring to FIGS. 1 and 2.

FIG. 1 is a schematic view illustrating an embodiment of the developing device of the present invention. This developing device is used for electrophotographic copiers.

Numeral 1 denotes a photoreceptor drum which serves as a latent image bearer and which rotates in a direction indicated by an arrow A. The photoreceptor 1 is charged with a charger 2. Then imagewise light 3 irradiates the charged photoreceptor 1 according to the original image information read by a scanner, to form an electrostatic latent image thereon. The electrostatic latent image is developed with a developer which includes a toner and which is born on a developing roller 41 of a developing device 4 to from a toner image on the photoreceptor 1. The toner is the toner of the present invention.

Then the toner image formed on the photoreceptor 1 is transferred onto a receiving material P which is timely fed by a registration roller 7 toward a nip between the photoreceptor 1 and a transfer belt 5.

The surface of the photoreceptor 1 is cleaned by a cleaner 6 including a cleaning brush 61 and a cleaning blade 62 after the toner image is transferred onto the receiving material P. A discharge lamp 9 irradiates the surface of the photoreceptor 1 with light to reduce the residual charges of the photoreceptor 1.

The developing device 4 includes developing rollers 41 and 42, a paddle agitator 43, an agitator 44, a doctor 45, a toner inlet 46 and a toner supplying roller 47.

Numerals 81 and 82 denote guide rails through which the developing device 4 is attached to or detached from the copier.

Whether or not the life of the cleaning blade 62 ends can be detected. Since the cleaning blade 62 always contacts the surface of the photoreceptor 1 when image forming operations are performed, the cleaning blade 62 is abraded as the photoreceptor rotates. When the cleaning blade 62 is abraded, the function of removing the toner remaining on the surface of the photoreceptor 1 deteriorates, and thereby the image qualities deteriorate.

When substantially a true spherical toner is used, the toner remaining on the surface of the photoreceptor 1 passes between the cleaning blade 62 and the photoreceptor 1, and thereby the cleaning is not well performed, although the transferability of toner images can be improved. However, the toner of the present invention does not cause such a cleaning problem.

Figure 2:
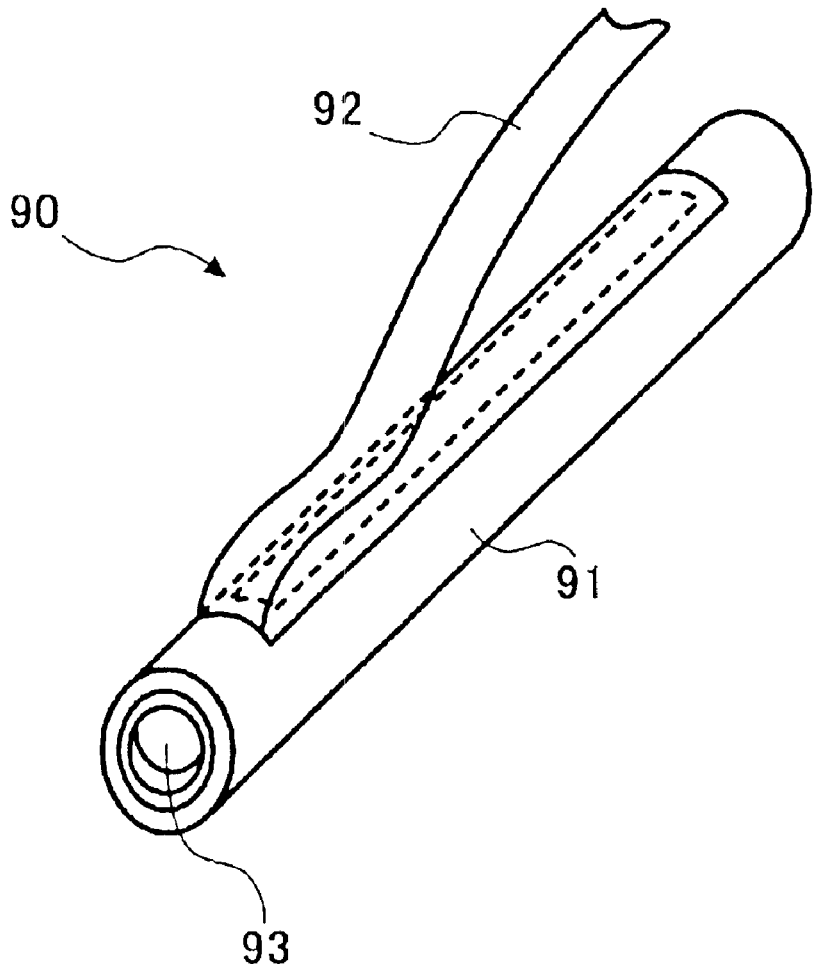
FIG. 2 is a schematic view illustrating an embodiment of the toner container of the present invention.

FIG. 2 is a schematic view illustrating a toner container. In FIG. 2, numerals 90, 91, 92 and 93 denote a container, a case, a seal and a plug. The toner container contains the toner of the present invention. When the toner is supplied to an image forming apparatus, the toner container is set therein and then the seal 92 is removed from the case 91.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis of Emulsion of Resin Particles

Manufacturing Example 1

In a reaction container equipped with a stirrer and a thermometer, 683 parts of water, 11 parts of a sodium salt of sulfate of an adduct of methacrylic acid with ethyleneoxide (EREMINOR RS-30 from Sanyo Chemical Industries Ltd.), 83 parts of styrene, 83 parts of methacrylic acid, 110 parts of butyl acrylate, and 1 part of ammonium persulfate were added and the mixture was agitated for 15 minutes at a revolution of 400 rpm. As a result, a white emulsion was obtained. Then the emulsion was heated to 75° C. to perform a reaction for 5 hours. Then 30 parts of a 1% aqueous solution of ammoniumpersulfate were added to the emulsion and the mixture was further aged for 5 hours at 75° C. Thus, an aqueous dispersion (particle dispersion 1) of a vinyl resin (i.e., a copolymer of styrene-methacrylic acid-butyl methacrylate-a sodium salt of a sulfate of an adduct of methacrylic acid with ethyleneoxide) was prepared. The volume average particle diameter of the particle dispersion 1 was 0.10 $\mu$m when measured with an instrument LA-920.

A part of the particle dispersion 1 was dried to prepare a particulate resin. The glass transition temperature of the particulate resin was 57° C.

Preparation of Aqueous Phase

Manufacturing Example 2

Eighty (80) parts of the particle dispersion 1 were mixed with 990 parts of water, 40 parts of a 48.5% aqueous solution of sodium dodecyldiphenyletherdisulfonate (EREMINOR MON-7 from Sanyo Chemical Industries, Ltd.), and 90 parts of ethyl acetate. Thus, an oil phase 1 was prepared.

Synthesis of Low Molecular Weight Polyester

Manufacturing Example 3

In a reaction container equipped with a condenser, a stirrer and a pipe from which a nitrogen gas was supplied to the container, 220 parts of an adduct of bisphenol A with 2 moles of ethyleneoxide, 561 parts of an adduct of bisphenol A with 3 moles of propyleneoxide, 218 parts of terephthalic acid, 48 parts of adipic acid, and 2 parts of dibutyl tin oxide were mixed. Then the mixture was reacted for 8 hours at 230° C. under a normal pressure. Then the reaction was further performed for 5 hours under a reduced pressure of from 10 to 15 mmHg. In addition, 45 parts of trimellitic anhydride were added thereto and the mixture was reacted for 2 hours at 180° C. under a normal pressure. Thus, a low molecular weight polyester 1 was prepared. The low molecular weight polyester 1 had a number average molecular weight of 2500, a weight average molecular weight of 6700, a glass transition temperature of 43° C. and an acid value of 25.

Preparation of Prepolymer

Manufacturing Example 4

In a reaction container equipped with a condenser, a stirrer and a pipe from which a nitrogen gas was supplied to the container, 682 parts of an adduct of bisphenol A with 2 moles of ethyleneoxide, 81 parts of an adduct of bisphenol A with 2 moles of propyleneoxide, 283 parts of terephthalic acid, 22 parts of trimellitic anhydride, and 2 parts of dibutyl tin oxide were mixed. Then the mixture was reacted for 8 hours at 230° C. under a normal pressure. Then the reaction was further performed for 5 hours under a reduced pressure of from 10 to 15 mmHg. Thus, an intermediate polyester 1 was prepared. The intermediate polyester 1 had a number average molecular weight of 2100, a weight average molecular weight of 9500, a glass transition temperature of 55° C., an acid value of 0.5 and a hydroxyl value of 49.

In a reaction container equipped with a condenser, a stirrer and a pipe from which a nitrogen gas was supplied to the container, 411 parts of the intermediate polyester 1, 89 parts of isophorondiisocyanate and 500 parts of ethyl acetate were added. The mixture was reacted for 5 hours at 100° C. Thus, a prepolymer 1 was prepared. The prepolymer included a free isocyanate group in an amount of 1.53% by weight.

Synthesis of Ketimine

Manufacturing Example 5

In a reaction container equipped with a stirrer and a thermometer, 170 parts of isophoronediamine and 75 parts of methyl ethyl ketone were mixed. The mixture was reacted for 5 hours at 50 C. Thus, a ketimine compound 1 was prepared. The ketimine compound 1 had an amine value of 418.

Preparation of Master Batch

Manufacturing Example 6

Forty (40) parts of carbon black (REGAL 400R from Cabot Corp.), 60 parts of a polyester resin (RS-801 from Sanyo Chemical Industries, Ltd.) which serves as a binder resin and which has an acid value of 10, a weight average molecular weight of 20,000 and a glass transition temperature of 64° C., and 30 parts of water were mixed in a Henshel mixer. Thus, a mixture in which water penetrated into the aggregated pigment was prepared. This mixture was kneaded for 45 hours at 130° C. using a two-roll mill. Then the kneaded mixture was pulverized so as to have a particle diameter of 1 mm. Thus, a master batch 1 was prepared.

Preparation of Oil Phase

Manufacturing Example 7

In a reaction container equipped with a stirrer and a thermometer, 378 parts of low molecular weight polyester 1, 110 parts of carnauba wax, 22 parts of a metal complex of salicylic acid serving as a charge controlling agent (E-84 from Orient Chemical Industries Co., Ltd.) and 947 parts of ethyl acetate were mixed. The mixture was heated at 80° C. for 5 hours while agitated and then cooled to 30° C. while taking one hour. Then 500 parts of the master batch 1 and 500 parts of ethyl acetate were added thereto to be mixed for 1 hour. Thus, a toner constituent solution 1 was prepared.

Then 1324 parts of the toner constituent solution 1 were contained in a container, and then dispersed using a bead mill (ULTRAVISCOMILL from AIMEX) under the following conditions:

Liquid feeding speed: 1 kg/hr,

Disc rotation speed: 6 m/sec,

Diameter of beads: 0.5 mm,

Filling factor: 80% by volume, and

Repeat number of dispersion treatment: 3 times.

Thus, the carbon black and wax were dispersed. Then 1324 parts of a 65% ethyl acetate solution of the low molecular weight polyester 1 were added thereto, and the mixture was dispersed under the conditions mentioned above except that the repeat number of the dispersion treatment was changed to 1 time. Thus, a pigment/wax dispersion 1 was prepared. The solid content of the pigment/wax dispersion 1 was 50% when measured by heating the dispersion at 130° C. for 30 minutes.

Emulsification and Solvent Removal

Example 1

The following components were contained in a contained to be mixed for 1 minute using a TK HOMOMIXER (manufactured by Tokushu Kika Kogyo Co., Ltd.) at a revolution of 5,000 rpm.

| | |
|---|---|
| Pigment/wax dispersion 1 | 648 |
| Prepolymer 1 | 154 |
| Ketimine compound 1 | 6.6 |

Then, 1200 parts of the aqueous phase 1 were added thereto and the mixture was dispersed for 20 minutes using a TK HOMOMIXER at a revolution of 13,000 rpm. Thus, an emulsion slurry 1 was prepared.

In a container equipped with a stirrer and a thermometer, the emulsion slurry 1 was added and then was heated at 30° C. for 8 hour to remove the solvents therefrom. Then the slurry was aged at 45° C. for 4 hours to prepare a dispersion slurry 1. The volume average particle diameter and number average particle diameter of the dispersion slurry were 5.95 μm and 5.45 μm, respectively, when measured with a MULTICIZER II.

Washing and Drying

One hundred (100) parts of the emulsion slurry 1 were filtered by filtering under a reduced pressure. Then the following operations were performed.

(1) 100 parts of deionized water were added to the thus prepared cake and the mixture was mixed for 10 minutes by a TK HOMOMIXER at a revolution of 12,000 rpm and then filtered;

(2) 100 parts of a 10% aqueous solution of sodium hydroxide were added to the cake prepared in (1) and the mixture was mixed for 30 minutes by a TK HOMOMIXER at a revolution of 12,000 rpm while applying supersonic vibration thereto, and then filtered under a reduced pressure, wherein this washing using an alkali was repeated twice;

(3) 100 parts of a 10% hydrochloric acid were added to the cake prepared in (2) and the mixture was mixed for 10 minutes by a TK HOMOMIXER at a revolution of 12,000 rpm and then filtered; and (4) 300 parts of deionized water were added to the cake prepared in (3) and the mixture was mixed for 10 minutes by a TK HOMOMIXER at a revolution of 12,000 rpm and then filtered, wherein this washing was repeated twice to prepare a filtered cake 1.

The filtered cake 1 was dried for 48 hours at 45° C. using a circulating drier. The dried cake was sieved using a screen having openings of 75 μm. Thus a toner 1 was prepared. The volume average particle diameter (Dv) and number average particle diameter (Dn) of the toner 1 were 6.03 μm and 5.52 μm, respectively when measured with a MULTICIZER II. The ratio (DV/Dn) was 1.09.

Example 2

The procedure for preparation of the toner 1 was repeated except that the alkali washing was performed once. Thus a toner 2 was prepared. The volume average particle diameter (Dv) and number average particle diameter (Dn) of the toner 2 were 6.07 μm and 5.50 μm, respectively. The ratio (DV/Dn) was 1.10.

Example 3

The procedure for preparation of the toner 1 was repeated except that the charge controlling agent (in an amount of 22 parts) was not added to form a toner. Then 0.5 parts of a metal complex of salicylic acid serving as a charge controlling agent (E-84 from Orient Chemical Industries co., Ltd.) were added to 100 parts of the toner and stuck on the toner using a Q-form mixer manufactured by Mitsui Mining Co., Ltd. Thus, a toner 3 having a volume average particle diameter (Dv) of 5.80 μm, and a number average particle diameter (Dn) of 5.17 μm was prepared. The ratio (DV/Dn) was 1.12.

Preparation of Low Molecular Weight Polyester

Manufacturing Example 8

In a reaction container equipped with a condenser, a stirrer and a pipe from which a nitrogen gas was supplied to the container, 262 parts of an adduct of bisphenol A with 2 moles of ethyleneoxide, 202 parts of an adduct of bisphenol A with 2 moles of propyleneoxide, 236 parts of an adduct of bisphenol A with 3 moles of propyleneoxide, 266 parts of terephthalic acid, 48 parts of adipic acid, and 2 parts of dibutyl tin oxide were mixed. Then the mixture was reacted for 8 hours at 230° C. under a normal pressure. Then the reaction was further performed for 5 hours under a reduced pressure of from 10 to 15 mmHg. In addition, 34 parts of trimellitic anhydride were added thereto and the mixture was reacted for 2 hours at 180° C. under a normal pressure. Thus, a low molecular weight polyester 2 was prepared. The low molecular weight polyester 2 had a number average molecular weight of 2,390, a weight average molecular weight of 6,010, a glass transition temperature of 62° C. and an acid value of 20.7.

Preparation of Oil Phase

Manufacturing Example 9

In a reaction container equipped with a stirrer and a thermometer, 378 parts of the low molecular weight polyester 2, 110 parts of carnauba wax, 22 parts of a metal complex of salicylic acid serving as a charge controlling agent (E-84 from Orient Chemical Industries Co., Ltd.) and 947 parts of ethyl acetate were mixed. The mixture was heated at 80° C. for 5 hours while agitated and then cooled to 30° C. while taking one hour. Then 500 parts of the master batch 1 and 500 parts of ethyl acetate were added thereto to be mixed for 1 hour. Thus, a toner constituent solution 2 was prepared.

Then 1324 parts of the toner constituent solution 2 were contained in a container, and then dispersed using a bead mill (ULTRAVISCOMILL from AIMEX) under the following conditions:

Liquid feeding speed: 1 kg/hr,

Disc rotation speed: 6 m/sec,

Diameter of beads: 0.5 mm,

Filling factor: 80% by volume, and

Repeat number of dispersion treatment: 3 times.

Thus, the carbon black and wax were dispersed. Then 1324 parts of a 65% ethyl acetate solution of the low molecular weight polyester 2 were added thereto, and the mixture was dispersed under the conditions mentioned above except that the repeat number of the dispersion treatment was changed to 1 time. Thus, a pigment/wax dispersion 2 was prepared. The solid content of the pigment/wax dispersion 2 was 52% when measured by heating the dispersion at 130° C. for 30 minutes.

Example 4

The procedure for preparation of the toner 1 was repeated except that the pigment/wax dispersion 1 was replaced with the pigment/wax dispersion 2 and the alkali washing was performed twice without applying supersonic vibration. Thus, a toner 4 having a volume average particle diameter (Dv) of 6.30 μm and a number average particle diameter (Dn) of 5.68 μm was prepared. The ratio (Dv/Dn) was 1.11.

Example 5

The procedure for preparation of the toner 4 was repeated except that the alkali washing was performed once without applying supersonic vibration. Thus, a toner 5 having a volume average particle diameter (Dv) of 6.42 μm and a number average particle diameter (Dn) of 5.44 μm was prepared. The ratio (Dv/Dn) was 1.18.

Synthesis of Low Molecular Weight Polyester

Manufacturing Example 10

In a reaction container equipped with a condenser, a stirrer and a pipe from which a nitrogen gas was supplied to the container, 719 parts of an adduct of bisphenol A with 2 moles of propyleneoxide, 274 parts of terephthalic acid, 48 parts of adipic acid, and 2 parts of dibutyl tin oxide were mixed. Then the mixture was reacted for 8 hours at 230° C. under a normal pressure. Then the reaction was further performed for 5 hours under a reduced pressure of from 10 to 15 mmHg. In addition, 7 parts of trimellitic anhydride were added thereto and the mixture was reacted for 2 hours at 180° C. under a normal pressure. Thus, a low molecular weight polyester 3 was prepared. The low molecular weight polyester 3 had a number average molecular weight of 2,290, a weight average molecular weight of 5,750, a glass transition temperature of 65° C. and an acid value of 4.9.

Preparation of Oil Phase

Manufacturing Example 11

In a reaction container equipped with a stirrer and a thermometer, 378 parts of low molecular weight polyester 3, 110 parts of carnauba wax, 22 parts of a metal complex of salicylic acid serving as a charge controlling agent (E-84 from Orient Chemical Industries Co., Ltd.) and 947 parts of ethyl acetate were mixed. The mixture was heated at 80° C. for 5 hours while agitated and then cooled to 30° C. while taking one hour. Then 500 parts of the master batch 1 and 500 parts of ethyl acetate were added thereto to be mixed for 1 hour. Thus, a toner constituent solution 3 was prepared.

Then 1324 parts of the toner constituent solution 3 were contained in a container, and then dispersed using a bead mill (ULTRAVISCOMILL from AIMEX) under the following conditions:

Liquid feeding speed: 1 kg/hr,

Disc rotation speed: 6 m/sec,

Diameter of beads: 0.5 mm,

Filling factor: 80% by volume, and

Repeat number of dispersion treatment: 3 times.

Thus, the carbon black and wax were dispersed. Then 1324 parts of a 65% ethyl acetate solution of the lowmolecular weight polyester 3 were added thereto, and the mixture was dispersed under the conditions mentioned above except that the repeat number of the dispersion treatment was changed to 1 time. Thus, a pigment/wax dispersion 3 was prepared. The solid content of the pigment/wax dispersion 3 was 49% when measured by heating the dispersion at 130° C. for 30 minutes.

Example 6

The procedure for preparation of the toner 1 was repeated except that the pigment/wax dispersion 1 was replaced with the pigment/wax dispersion 3 and the alkali washing was performed 4 times without applying supersonic vibration. Thus, a toner 6 having a volume average particle diameter (Dv) of 7.05 μm and a number average particle diameter (Dn) of 5.64 μm was prepared. The ratio (Dv/Dn) was 1.25.

Example 7

The procedure for preparation of the toner 1 was repeated except that the pigment/wax dispersion 1 was replaced with the pigment/wax dispersion 3 and the alkali washing was performed twice without applying supersonic vibration. Thus, a toner 7 having a volume average particle diameter (Dv) of 7.05 μm and a number average particle diameter (Dn) of 5.64 μm was prepared. The ratio (Dv/Dn) was 1.25.

Synthesis of Low Molecular Weight Polyester

Manufacturing Example 12

In a reaction container equipped with a condenser, a stirrer and a pipe from which a nitrogen gas was supplied to the container, 121 parts of an adduct of bisphenol A with 2 moles of ethyleneoxide, 64 parts of an adduct of bisphenol A with 2 moles of propyleneoxide, 527 parts of an adduct of bisphenol A with 3 moles of propyleneoxide, 246 parts of terephthalic acid, 48 parts of adipic acid, and 2 parts of dibutyl tin oxide were mixed. Then the mixture was reacted for 8 hours at 230° C. under a normal pressure. Then the reaction was further performed for 5 hours under a reduced pressure of from 10 to 15 mmHg. In addition, 42 parts of trimellitic anhydride were added thereto and the mixture was reacted for 2 hours at 180° C. under a normal pressure. Thus, a low molecular weight polyester 4 was prepared. The low molecular weight polyester 4 had a number average molecular weight of 2,500, a weight average molecular weight of 6,190, a glass transition temperature of 48° C. and an acid value of 25.2.

Preparation of Oil Phase

Manufacturing Example 13

In a reaction container equipped with a stirrer and a thermometer, 378 parts of low molecular weight polyester 4, 110 parts of carnauba wax, 22 parts of a metal complex of salicylic acid serving as a charge controlling agent (E-84 from Orient Chemical Industries Co., Ltd.) and 947 parts of ethyl acetate were mixed. The mixture was heated at 80° C. for 5 hours while agitated and then cooled to 30° C. while taking one hour. Then 500 parts of the master batch 1 and 500 parts of ethyl acetate were added thereto to be mixed for 1 hour. Thus, a toner constituent solution 4 was prepared.

Then 1324 parts of the toner constituent solution 4 were contained in a container, and then dispersed using a bead mill (ULTRAVISCOMILL from AIMEX) under the following conditions:

Liquid feeding speed: 1 kg/hr,

Disc rotation speed: 6 m/sec,

Diameter of beads: 0.5 mm,

Filling factor: 80% by volume, and

Repeat number of dispersion treatment: 3 times.

Thus, the carbon black and wax were dispersed. Then 1324 parts of a 65% ethyl acetate solution of the low molecular weight polyester 4 were added thereto, and the mixture was dispersed under the conditions mentioned above except that the repeat number of the dispersion treatment was changed to once. Thus, a pigment/wax dispersion 4 was prepared. The solid content of the dispersion 4 was 49% when measured by heating the dispersion at 130° C. for 30 minutes.

Example 8

The procedure for preparation of the toner 1 was repeated except that the pigment/wax dispersion 1 was replaced with the pigment/wax dispersion 4. Thus, a toner 8 having a volume average particle diameter (Dv) of 4.80 μm and a number average particle diameter (Dn) of 4.00 μm was prepared. The ratio (Dv/Dn) was 1.20.

Example 9

The procedure for preparation of the toner 1 was repeated except that the pigment/wax dispersion 1 was replaced with the pigment/wax dispersion 4 and the alkali washing was performed once while applying supersonic vibration. Thus, a toner 7 having a volume average particle diameter (Dv) of 5.11 μm and a number average particle diameter (Dn) of 4.22 μm was prepared. The ratio (Dv/Dn) was 1.21.

Comparative Example 1

In a container, 709 parts of deionized water and 451 parts of a 0.1 mole aqueous solution of $Na_3PO_4$ were mixed. After the mixture was heated to 60° C., the mixture was agitated with a TK HOMOMIXER at a revolution of 12,000 rpm. Then 68 parts of a 1.0 mole aqueous solution of $CaCl_2$ were gradually added thereto to prepare an aqueous medium including $Ca_3(PO_4)_2$. Then 170 parts of styrene, 30 parts of 2-ethylhexyl acrylate, 10 parts of a carbon black (REGAL400R from Cabot Corp.), 60 parts of paraffin wax having a softening point of 70° C., 5 parts of a metal compound of di-tert-butyl salicylate and 10 parts of a styrene-methacrylic acid copolymer having a weight average molecular weight of 50,000 and an acid value of 20 mgKOH/g were mixed in a container and the mixture was heated to 60° C. Then the mixture was agitated with a TK HOMOMIXER at a revolution of 12,000 rpm to be uniformly dissolved and dispersed. Then 10 parts of a polymerization initiator, 2,2'-azobis(2,4-dimethylvaleronitrile) were dissolved therein. Thus, a polymerizable liquid was prepared.

This polymerizable liquid was added to the above-prepared aqueous medium and the mixture was agitated for 20 minutes at 60° C. using a TK HOMOMIXER at a revolution of 10,000 rpm under a nitrogen atmosphere. The thus prepared polymerizable monomer particles dispersion was reacted for 3 hours at 60° C. while agitated with a paddle agitator. Then the liquid was heated to 80° C. and further reacted for 10 hours.

After completion of the reaction, the liquid was cooled and hydrochloric acid was added thereto to dissolve calcium phosphate. Then the liquid was filtered and the cake was washed and dried. Thus, a toner 10 having a volume average particle diameter (Dv) of 6.30 μm, and a number average particle diameter of 5.65 μm was prepared. The ratio (Dv/Dn) was 1.12.

Comparative Example 2

Preparation of Aqueous Wax Particle Dispersion

Manufacturing Example 14

In a 1000 ml four-neck flask equipped with a stirrer, a thermosensor, a condenser and a pipe through which a nitrogen gas was supplied to the flask, 500 ml of distilled water which had been degassed, 28.5 g of dispersant NEWCALL 565C (manufactured by Nippon Emulsifier Co., Ltd.), and 185.5 g of candelilla wax No. 1 (manufactured by Noda Wax Co., Ltd.) were mixed. The mixture was heated under a nitrogen gas flow. When the temperature of the inside of the flask reached 85° C., a 5N aqueous solution of sodium hydroxide was added thereto, and the temperature was maintained at 75° C. The mixture was agitated for 1 hour while the temperature was maintained. Then the liquid was cooled to room temperature. Thus, a wax particle dispersion 1 was prepared.

Preparation of Aqueous Colorant Dispersion

One hundred grams of a carbon black (MOGAL L from Cabot Corp.) and 25 g of sodium dodecylsulfate were added to 540 ml of distilled water. After being agitated, the mixture was dispersed using a pressure dispersing machine (MINILAB from Larney Corp.). Thus an aqueous colorant dispersion 1 was prepared.

Preparation of Aqueous Binder Particle Dispersion

Manufacturing Example 15

In a 1000 ml four-neck flask equipped with a stirrer, a thermosensor, a condenser and a pipe through which a nitrogen gas was supplied to the flask, 480 ml of distilled water, 0.6 g of sodium dodecylsulfate, 106.4 g of styrene, 43.2 g of n-butyl acrylate and 10.4 g of methacrylic acid were mixed and heated to 70° C. while agitated under a nitrogen gas flow. An aqueous initiator solution in which 2.1 g of potassium persulfate were dissolved in 120 ml of distilled water was added thereto, and the mixture was agitated for 3 hours at 70° C. under a nitrogen gas flow. After completion of the reaction, the liquid was cooled to room temperature. Thus, a high molecular weight binder particle dispersion 1 was prepared.

In a 5000 ml four-neck flask equipped with a stirrer, a thermosensor, a condenser and a pipe through which a nitrogen gas was supplied to the flask, 2400 ml of distilled water, 2.8 g of sodium dodecylsulfate, 620 g of styrene, 128 g of n-butyl acrylate, 52 g of methacrylic acid and 27.4 g of tert-dodecyl mercaptan were contained and heated to 70° C. while agitated under a nitrogen gas flow. An aqueous initiator solution in which 11.2 g of potassium persulfate were dissolved in 600 ml of distilled water was added thereto, and the mixture was agitated for 3 hours at 70° C. under a nitrogen gas flow. After completion of the reaction, the liquid was cooled to room temperature. Thus, a low molecular weight binder particle dispersion 2 was prepared.

Preparation of Toner

Manufacturing Example 16

In a 1000 ml separable flask equipped with a stirrer, a thermosensor, a condenser and a pipe through which a nitrogen gas was supplied to the flask, 47.6 g of the high molecular weight binder particle dispersion 1 and 190.5 g of the low molecular weight binder particle dispersion 2, 7.7 g of the aqueous wax particle dispersion 2, 26.7 g of the aqueous colorant dispersion 1 and 252.5 ml of distilled water were contained and agitated to be mixed. Then a 5N aqueous solution of sodium hydroxide was added thereto to control the pH of the mixture at 9.5. Then an aqueous solution of sodium chloride in which 50 g of sodium chloride was dissolved in 600 ml of distilled water, 77 ml of isopropanol, and an aqueous solution of a surfactant in which 10 mg of a fluorine-containing nonion surfactant FLUORARD FC-170C from Sumitomo 3M Ltd. were dissolved in 10 ml of distilled water were added thereto in this order. The mixture was heated such that the temperature of the inside of the flask was 85° C. to perform a reaction for 6 hours. Then the reaction product was cooled to room temperature and the pH thereof was adjusted so as to be 13 using a 5N aqueous solution of sodium hydroxide. Then the reaction product was filtered and the cake was re-suspended in distilled water. The suspension was then filtered. This washing treatment was repeated and then the cake was dried. Thus, a toner 11 having a volume average particle diameter (Dv) of 6.52 μm and a number average particle diameter (Dn) of 5.31 μm was prepared. The ratio (Dv/Dn) was 1.23.

Comparative Example 3

Preparation of Pigment Dispersion

Manufacturing Example 17

In a resin container, 0.9 parts of sodium n-dodecylsulfate, and 10 parts of deionized water were contained and agitated to prepare an aqueous solution of sodium n-dodecylsulfate. Then 1.2 parts of a carbon black (REGAL 400R from Cabot Corp.) were gradually added thereto while the aqueous solution was agitated. After adding the carbon black, the mixture was further agitated for 1 hour. Then the mixture was subjected to a continuous dispersion treatment for 20 hours using a sand grinder. Thus, a pigment dispersion C-1 was prepared.

Preparation of Aqueous Surfactant Solution

In a stainless container, 0.055 parts of an anionic surfactant, sodium dodecylbenzenesulfonate, and 4 parts of deionized water were contained and agitated at room temperature. Thus, a liquid S-1 was prepared.

In a stainless container, 0.014 parts of a nonionic surfactant, NEWCALL 565C from Nippon Emulsifier Co., Ltd., and 4 parts of deionized water were contained and agitated at room temperature. Thus, a liquid S-2 was prepared.

In a glass container, 1 part of a nonionic surfactant, NEWCALL 565C from Nippon Emulsifier Co., Ltd., and 1000 parts of deionized water were contained and agitated at room temperature. Thus, a liquid S-3 was prepared.

Preparation of Aqueous Polymerization Initiator Solution

Manufacturing Example 18

In an enameled container, 200.7 parts of a polymerization initiator, potassium persulfate (manufactured by Kanto Kagaku) and 12,000 parts of deionized water were contained and agitated at room temperature. Thus, a liquid P-1 was prepared.

In addition, in an enameled container, 223.8 parts of a polymerization initiator, potassium persulfate (manufactured by Kanto Kagaku) and 12,000 parts of deionized water were contained and agitated at room temperature. Thus, a liquid P-2 was prepared.

Preparation of Sodium Chloride

In a stainless container, 5.36 parts of a salting-out agent, sodium chloride (manufactured by Wako Pure Chemical Industries, Ltd.) and 20 parts of deionized water were contained and agitated at room temperature. Thus, a sodium chloride solution N was prepared.

Preparation of Complex Resin Particle Dispersion

Manufacturing Example 19

In a 100-liter reaction vessel which is equipped with a stirrer, a thermosensor, a condenser and a pipe through which a nitrogen gas was supplied to the vessel and whose inside is lined with glass, 4 litters of the liquid (S-1) and 4 litters of the liquid (S-2) were contained and agitated to be mixed at room temperature. Then 44 liters of deionized water were added thereto and the mixture was heated. When the mixture was heated to 70° C., 12 litter of the liquid P-1 were added thereto and the mixture was heated such that the temperature thereof was controlled so as to be 72±1° C. Then a monomer mixture (I) of 12.1 kg of styrene, 2.88 kg of n-butyl acrylate, 1.04 kg of methacrylic acid, and 9.02 g of t-dodecylmercaptan was added thereto, and the mixture was agitated for 6 hours while heated such that the temperature thereof was controlled so as to be 80±1° C. After the liquid was cooled to a temperature not higher than 40° C., 4 litters of the liquid S-1, and 4 litters of the liquid S-2 were added thereto and the mixture was heated.

When the mixture was heated to 70° C., 12 litters of the liquid P-2 were added thereto, and then a monomer mixture (II) of 11 kg of styrene, 4 kg of n-butyl acrylate, 1.04 kg of methacrylic acid, and 548 g of t-dodecylmercaptan was further added thereto. The liquid was agitated for 6 hours while heated such that the temperature thereof was controlled so as to be 75±2° C. Further, the liquid was agitated for 12 hours while heated such that the temperature thereof was controlled so as to be 80±2° C.

Then the reaction product was cooled to a temperature not higher than 40° C. and agitating was stopped. Then scales (foreign materials) were removed therefrom using a Paul filter. Thus, a dispersion of complex resin particles (A) (a complex latex (1-A)) in which a core of high molecular weight resin is covered with a shell of a low molecular weight resin was prepared. The high molecular weight resin (the core resin) had a peak molecular weight of 29,000 and the low molecular weight resin (the shell resin) had a peak molecular weight of 12,000. The complex resin particles (A) had a weight average molecular weight of 34,000, a weight average particle diameter of 150 nm, a glass transition temperature of 58° C., and a softening point of 121° C.

In a 100-liter reaction vessel which was equipped with a thermosensor, a condenser, a pipe through which a nitrogen gas was supplied to the vessel, a comb-form baffle and an agitator (Faudler blade) and whose inside is lined with glass, 4 litters of the liquid (S-1) and 4 litters of the liquid (S-2) were contained and agitated to be mixed at room temperature. Then 44 liters of deionized water were added thereto and the mixture was heated. When the mixture was heated to 70° C., 12 litters of the liquid P-1 were added thereto and a monomer mixture of 11 kg of styrene, 4 kg of n-butyl acrylate, 1.04 kg of methacrylic acid, and 9.02 g of t-dodecylmercaptan was added thereto, and the mixture was agitated for 6 hours while heated such that the temperature thereof was controlled so as to be 72±2° C. Further, the liquid was agitated for 12 hours while heated such that the temperature thereof was controlled so as to be 80±2° C.

Then the reaction product was cooled to a temperature not higher than 40° C. and agitating was stopped. Then scales (foreign materials) were removed therefrom using a Paul filter. Thus, a dispersion of complex resin particles (B) (a complex latex (1-B)) was prepared. The complex resin particles (B) had a peak molecular weight of 310,000, a weight average molecular weight of 190,000, a weight average particle diameter of 138 nm, a glass transition temperature of 58° C., and a softening point of 126° C.

Preparation of Toner

Manufacturing Example 20

In a 100-liter stainless reaction vessel equipped with a thermosensor, a condenser, a pipe through which a nitrogen gas was supplied to the vessel, a comb-form baffle and an agitator (anchor blade), 20 kg of the complex latex (1-A), 0.4 kg of the pigment dispersion (C-1) and 20 kg of deionized water were contained and agitated at room temperature. The mixture was heated to 40° C. Then 20 litters of the sodium chloride solution (N), 6 kg of isopropylalcohol (manufactured by Kanto Kagaku), 1 part of a nonionic surfactant, FC-170C (manufactured by Sumitomo 3M Ltd.) and 1000 parts of deionized water were contained in a glass vessel and agitated at room temperature. Thus a liquid (S-3) was prepared. One litter of the liquid (S-3) was added thereto.

After being allowed to settle for 10 minutes, the liquid was heated to 85° C. while taking 60 minutes. Then the liquid was heated at a temperature of 85±2° C. while agitated for 1 hour to salt-out/fuse the complex resin particles (A) and the colorant particles. Thus, colored particles (i.e., core particles) were prepared.

Then 5.2 kg of the latex (1-B) and 3.41 kg of an emulsion of a polypropylene wax having a number average molecular weight of 3,000, which emulsion has a number average primary particle diameter of 120 nm and a solid content of 29.9% by weight, were added thereto while the temperature thereof was controlled so as to be 85±2° C. Further, the mixture was agitated for 4 hours while heated at 85±2° C. to salt-out/fuse the complex resin particles (B) and polypropylene particles on the surface of the colored particles (core particles). After the liquid was cooled to a temperature not higher than 40° C. and agitating was stopped, the liquid was filtered using a screen having openings of 45 $\mu$m to remove aggregates. Thus, a toner particle dispersion was prepared. Then the dispersion was filtered under a reduced pressure to prepare a wet cake (i.e., aggregates of toner particles). The wet cake was washed with deionized water. The washed wet cake was then dried for 100 hours at 40° C. using a fan drier. Thus, aggregate toner particles were prepared. Then the aggregate toner particles were subjected to a releasing treatment using a Henshel pulverizer. Thus, a toner 12 having a volume average particle diameter (Dv) of 6.40 $\mu$m and a number average particle diameter (Dn) of 5.30 $\mu$m was prepared. The ratio (Dv/Dn) was 1.21.

Comparative Example 4

The procedure for preparation of the toner 1 was repeated except that the aqueous phase 1 was replaced with the following aqueous phase 2.

| | |
|---|---|
| Polyvinyl alcohol (PVA-235 manufactured by Kuraray Co., Ltd.) | 1 |
| Water | 100 |

Thus, a toner 13 was prepared.

Comparative Example 5

The procedure for preparation of the toner 1 was repeated except that the alkali washing and hydrochloric acid washing were not performed. Thus, a toner 14 having a volume average particle diameter (Dv) of 6.21 μm and a number average particle diameter (Dn) of 5.30 μm was prepared. The ratio (Dv/Dn) was 1.17.

Comparative Example 6

Preparation of Organic Particle Emulsion

Manufacturing Example 21

In a reaction vessel equipped with an agitator and a thermometer, 683 parts of water, 11 parts of a sodium salt of sulfate of an adduct of methacrylic acid with ethylene oxide (EREMINOR RS-30 from Sanyo Chemical Industries, Ltd.), 138 parts of styrene, 138 parts of methacrylic acid and 1 part of ammonium persulfate were contained and agitated for 15 minutes at a revolution of 400 rpm. As a result, a white emulsion was prepared. The emulsion was heated to 75° C. to perform a reaction for 5 hours. In addition, 30 parts of a 1% aqueous solution of ammonium persulfate were added thereto and aged for 5 hours at 75° C. Thus, an aqueous dispersion (particle dispersion 2) of a vinyl resin (a copolymer of styrene, methacrylic acid, and a sodium salt of a sulfate of an adduct of methacrylic acid with ethylene oxide) was prepared. The volume average particle diameter of the particle dispersion 2 was 0.14 μm when measured with an instrument LA-920.

By drying a part of the particle dispersion 2, resin particles were prepared. The glass transition temperature of the resin particles was 152° C.

Preparation of Aqueous Phase

Manufacturing Example 22

In a container, 990 parts of water, 80 parts of the particle dispersion 2, 40 parts of a 48.5% aqueous solution of sodium dodecyldiphenylether disulfonate (EREMINOR MON-7 manufactured by Sanyo Chemical Industries, Ltd.) and 90 parts of ethyl acetate were mixed. As a result, a milk white liquid (an aqueous phase 3) was prepared.

The procedure for preparation of the toner 1 was repeated except that the aqueous phase 1 was replaced with the aqueous phase 3. Thus, a toner 15 having a volume average particle diameter (Dv) of 6.05 μm and a number average particle diameter of 5.45 μm was prepared. The ratio (Dv/Dn) was 1.11 and the remaining ratio of the resin particles was 2.2%.

Example 10

Mixing Process

The following components were kneaded using a Bumbury's mixer (manufactured by Kobe Steel, Ltd.) to prepare a mixture.

| | |
|---|---|
| Styrene-n-butyl acrylate resin (copolymerization ratio of 55:45, Mn of 3,100, Mw of 8,200 and manufactured by a solution polymerization method) | 90 |
| Carbon black (manufactured by Cabot Corp.) | 5 |
| Polypropylene (molecular weight of 8,000 and manufactured by Mitsui Petrochemical Industries, Ltd.) | 5 |

Then 100 parts of the mixture were added to 400 parts of ethyl acetate and the mixture was agitated for 2 hours at 20° C. Thus, 500 parts of a toner constituent solution including the styrene-n-butyl acrylate resin were prepared.

Suspension Process

The following components were mixed with a supersonic dispersion machine to prepare an aqueous liquid.

| | |
|---|---|
| Dried particle dispersion 1 | 15 |
| Carboxymethyl cellulose (etherification degree of 0.75, average polymerization degree of 850 and manufactured by Dai-ichi Kogyo Seiyaku Co., Ltd.) | 0.03 |
| Deionized water | 99.97 |

Then 100 parts of the toner constituent solution were gradually added to 220 parts of the thus prepared aqueous liquid which were agitated by a homogenizer (manufactured by IKA) at a revolution of 10,000 rpm. The mixture was further agitated for 2 minutes. Thus 320 g of a suspension were prepared.

Solvent Removing Process

The thus prepared suspension was heated to 50° C. while agitated. The suspension was maintained for 3 hours at 50° C., and then cooled to room temperature.

Washing and Dewatering Process

Forty (40) parts of 10N hydrochloric acid were added to 200 parts of the suspension subjected to the solvent removing treatment. Then the mixture was suction-filtered and then a washing treatment in which the cake was washed with deionized water was repeated 4 times.

Drying and Sieving Process

The thus prepared particle cake was dried in a vacuum drier followed by a sieving treatment using a screen having openings of 45 μm. Thus, a toner 16 was prepared.

Example 11

The procedure for preparation of the toner 1 was repeated except that the alkali washing treatment was not performed. Thus a toner 17 having a volume average particle diameter (Dv) of 6.21 μm and a number average particle diameter (Dn) of 5.30 μm was prepared. The ratio (Dv/Dn) was 1.17.

Example 12

Preparation of Organic Particle Emulsion

Manufacturing Example 23

In a reaction vessel equipped with an agitator and a thermometer, 683 parts of water, 11 parts of a sodium salt of a sulfate of an adduct of methacrylic acid with ethylene oxide (EREMINOR RS-30 from Sanyo Chemical Industries, Ltd.), 103 parts of styrene, 103 parts of methacrylic acid and 1 part of ammonium persulfate were contained and agitated for 15 minutes at a revolution of 400 rpm. As a result, a white emulsion was prepared. The emulsion was heated to 75° C. to perform a reaction for 5 hours. In addition, 30 parts of a 1% aqueous solution of ammonium persulfate were added thereto and aged for 5 hours at 75° C. Thus, an aqueous dispersion (particle dispersion 3) of a vinyl resin (a copolymer of styrene, methacrylic acid, and a sodium salt of a sulfate of an adduct of methacrylic acid with ethylene oxide) was prepared. The volume average particle diameter of the particle dispersion 3 was 0.11 μm when measured by an instrument LA-920.

By drying a part of the particle dispersion 3, resin particles were prepared. The glass transition temperature of the resin particles was 82° C.

Preparation of Aqueous Phase

Manufacturing Example 24

In a container, 990 parts of water, 80 parts of the particle dispersion 3, 40 parts of a 48.5% aqueous solution of sodium dodecyldiphenylether disulfonate (EREMINOR MON-7 manufactured by Sanyo Chemical Industries, Ltd.) and 90 parts of ethyl acetate were mixed. As a result, a milk white liquid (an aqueous phase 4) was prepared.

The procedure for preparation of the toner 1 was repeated except that the aqueous phase 1 was replaced with the aqueous phase 4. Thus a toner 18 was prepared.

The thus prepared toners were evaluated as follows.

One hundred parts of each of the toners were mixed with 0.7 parts of a hydrophobic silica and 0.3 parts of a hydrophobic titanium oxide using a Henshel mixer.

The thus prepared toner with external additives was mixed with a copper-ferrite carrier which had been coated with a silicone resin and which has an average particle diameter of 45 μm in a weight ratio of 5:95 to prepare a developer.

The evaluation items are as follows.

(1) Particle Diameter (Dv, Dn)

The particle diameter (i.e., volume average particle diameter and number average particle diameter) of a toner was measured with a particle diameter measuring instrument, COULTER COUNTER TAII, manufactured by Coulter Electronics, Inc., which was equipped with an aperture having a diameter of 100 μm.

(2) Charge Quantity (Q/M)

Six (6) grams of a developer were contained in a closed metal cylinder and subjected to a blow-off treatment to determine the charge quantity of the toner. In this case, the toner concentration of the developer was adjusted so as to range from 4.5 to 5.5% by weight.

(3) Fixability

Each developer was set in a copier, IMAGIO NEO 450, which can produce 45 copies of A4 size per minute, and black solid images were continuously produced on a plain paper (TYPE 6200 paper from Ricoh Co., Ltd.) and a thick paper (COPY/PRINT PAPER 135 from NBS Ricoh) while the developing conditions were controlled such that the weight of the solid toner image is 1.0±0.1 mg/cm$^2$.

In addition, the temperature of the fixing belt was changed to determine the offset temperature (when the plain paper was used) and the lower limit fixing temperature (when the thick paper was used). The lower limit fixing temperature was determined as the lowest fixing temperature of the heat roller in a fixing temperature range in which a fixed image has a residual image density not lower than 70% when the image was rubbed with a pad.

(4) Spherical Degree (S.D.)

The spherical degree can be measured by a flow type particle image analyzer FPIA-2100 manufactured by SYSMEX CORPORATION. The average spherical degree of each toner was determined.

The specific procedure is as follows:

1) a surfactant serving as a dispersant, preferably 0.1 to 5 ml of an alkylbenzenesulfonic acid salt, is added to 100 to 150 ml of water from which solid impurities had been removed;
2) 0.1 to 0.5 g of a sample to be measured is added into the mixture prepared in (1);
3) the mixture prepared in (2) is subjected to an ultrasonic dispersion treatment for about 1 to 3 minutes such that the concentration of the particles is 3,000 to 10,000 particles per microlitter; and
4) the shape and average particle diameter distribution of the sample are determined using the instrument mentioned above.

(5) Covering Ratio (C.R.)

Particles of each toner were observed with an electron microscope of 50,000 power magnification and photographs of several locations were taken. Among the photographs, a typical toner particle which does not have cracks or the like was selected and the surface thereof was analyzed with an image analyzer, LUSEX III. Thus, the covering ratio of the surface of the toner particle with resin particles was determined.

(6) Remaining Ratio (R.R.) of Resin Particles

The styrene monomer which is one of the heat decomposition products of the resin particles included in each toner was determined by pyrolysis gas chromatography by measuring the area of the peak of the styrene monomer. A working curve was previously prepared using toners in which styrene-acrylic resin particles are added to a toner in an amount of 0.01, 0.10, 1.00, 3.00 or 10.0% by weight.

The measuring conditions are as follows.

Instrument: QR-5000 manufactured by Shimadzu Corp.

JHP-3S manufactured by Japan Analytical Industry Co., Ltd.

Heat decomposition temperature: 590° C. (for 12 seconds)

Column: DB-1 (length of 30 m and inside diameter of 0.25 mm) Film having a thickness of 0.25 μm Column temperature: 40° C. (retained for 2 minutes) to 300° C.

Temperature rising speed: 10° C./min

Temperature of vaporizing room: 300° C.

(7) Glass Transition Temperature (Tg)

In the present invention, the glass transition temperature was measured by a TG-DSC system TAS-100 manufactured by RIGAKU CORPORATION. The procedure for measurements of glass transition temperature is as follows:

1) a sample of about 10 mg is contained in an aluminum container, and the container is set on a holder unit;
2) the holder unit is set in an electrical furnace, and the sample is heated from room temperature to 150° C. at a temperature rising speed of 10° C./min;
3) after the sample is allowed to settle at 150° C. for 10 minutes, the sample is cooled to room temperature;
4) after the sample is allowed to settle at room temperature for 10 minutes; and
5) the sample is again heated under a nitrogen atmosphere from room temperature to 150° C. at a temperature rising speed of 10° C./min to perform a DSC measurement.

The glass transition temperature of the sample was determined using an analysis system of the TAS-100 system. Namely, the glass transition temperature is defined as the contact point between the tangent line of the endothermic curve at the temperatures near the glass transition temperature and the base line of the DSC curve.

(8) Image Density

A 100,000-sheet running test was performed using each developer and the copier (IMAGIO NEO 450).

The image density of the solid images was measured by a densitometer, X-Rite, manufactured by X-Rite Corp. The image densities of 5 images were averaged to obtain an average image density.

(9) Background Fouling

When a white image was developed with each toner, the operations of the copier were stopped. The toner particles present on the surface of the photoreceptor was transferred to an adhesive tape. The reflection densities of the adhesive tapes with or without toner particles were measured with a spectrodensitometer 938 manufactured by X-Rite to determine the difference in reflection density between the adhesive tape with toner particles and the adhesive tape without toner particles.

(10) Dot Reproducibility (D.R.)

The dot reproducibility of the image was visually evaluated while classifying as follows.

⊙: Excellent

○: good

: poor

(11) Cleanability

The toner particles remaining on the photoreceptor were transferred on a SCOTCH adhesive tape manufactured by Sumitomo 3M Limited. The adhesive tape with the toner particles was adhered to a white paper to measure the reflection density thereof. The cleanability was evaluated by classifying as follows:

○: the difference in reflection density is not greater than 0.01.

: the difference in reflection density is greater than 0.01.

(12) Toner Filming

The surfaces of the developing roller and photoreceptor were visually observed to determine whether a toner film was formed thereon.

The toner filming was evaluated by classifying as follows:

○: a film is not formed thereon.

Δ: streak-like films are observed.

: a film is formed entire the surface thereof.

The toners 10, 14 and 15 produced images having poor fixing properties, and therefore the 100,000-sheet running tests using the toners were not performed.

The toners 11 and 12 produced images having slightly poor fixing properties, and after a 10,000-sheet running test, the image has serious background fouling due to deterioration of the charging ability thereof. Therefore the running test was stopped at the time.

Since the particle diameter of the toner 13 could not be controlled, the resultant images had serious background fouling. Therefore the running test was not performed.

The results are shown in Tables 1 to 3.

TABLE 1

| | | Particle diameter | | | | | | | |
|---|---|---|---|---|---|---|---|---|---|
| | Toner | Dv | Dn | Dv/Dn | S.D. | C.R. (%) | R.R. (%) | Q/M (−μC/g) | D.R. |
| Ex. 1 | 1 | 6.03 | 5.52 | 1.09 | 0.951 | 44.0 | 0.1 | 23.5 | ⊙ |
| Ex. 2 | 2 | 6.07 | 5.50 | 1.10 | 0.953 | 32.0 | 0.5 | 24.1 | ⊙ |
| Ex. 3 | 3 | 5.80 | 5.17 | 1.12 | 0.957 | 47.0 | 0.2 | 25.4 | ⊙ |
| Ex. 4 | 4 | 6.30 | 5.68 | 1.11 | 0.949 | 41.0 | 1.4 | 26.5 | ⊙ |
| Ex. 5 | 5 | 6.42 | 5.44 | 1.18 | 0.945 | 37.0 | 2.5 | 27.8 | ⊙ |
| Ex. 6 | 6 | 7.05 | 5.64 | 1.25 | 0.956 | 46.0 | 1.5 | 25.9 | ○ |
| Ex. 7 | 7 | 7.05 | 5.64 | 1.25 | 0.955 | 39.0 | 2.2 | 27.1 | ○ |
| Ex. 8 | 8 | 4.80 | 4.00 | 1.20 | 0.954 | 21.0 | 0.3 | 24.2 | ⊙ |
| Ex. 9 | 9 | 5.11 | 4.22 | 1.21 | 0.956 | 25.0 | 0.8 | 25.1 | ○ |
| Ex. 10 | 16 | 9.07 | 8.54 | 1.06 | 0.982 | 33.3 | 21.9 | 21.9 | ⊙ |
| Ex. 11 | 17 | 6.21 | 5.30 | 1.17 | 0.950 | 85.0 | — | 27.1 | ⊙ |
| Ex. 12 | 18 | 6.03 | 5.46 | 1.10 | 0.953 | 40.0 | — | 29.0 | ⊙ |
| Comp. Ex. 1 | 10 | 6.30 | 5.65 | 1.12 | 0.983 | — | — | 27.4 | ⊙ |
| Comp. Ex. 2 | 11 | 6.52 | 5.31 | 1.23 | 0.960 | — | — | 26.8 | ○ |
| Comp. Ex. 3 | 12 | 6.40 | 5.30 | 1.21 | 0.958 | — | — | 24.1 | ○ |
| Comp. Ex. 4 | 13 | 15.34 | 10.39 | 1.48 | 0.902 | — | 0.0 | 12.5 | |
| Comp. Ex. 5 | 14 | 6.21 | 5.30 | 1.17 | 0.950 | 93.0 | 3.5 | 28.1 | ⊙ |
| Comp. Ex. 6 | 15 | 6.05 | 5.45 | 1.11 | 0.950 | 41.0 | — | 29.1 | ⊙ |

S.D.: spherical degree

C.R.: covering ratio

R.R.: remaining ratio

Q/M: charge quantity

D.R.: dot reproducibility

TABLE 2

| | Image density | | | Background fouling | | | Cleanability | | |
|---|---|---|---|---|---|---|---|---|---|
| | First image | 10,000th image | 100,000th image | First image | 10,000th image | 100,000th image | First image | 10,000th image | 100,000th image |
| Ex. 1 | 1.41 | 1.45 | 1.42 | 0.01 | 0.01 | 0.00 | ○ | ○ | ○ |
| Ex. 2 | 1.38 | 1.41 | 1.41 | 0.01 | 0.00 | 0.01 | ○ | ○ | ○ |
| Ex. 3 | 1.36 | 1.39 | 1.39 | 0.00 | 0.00 | 0.01 | ○ | ○ | ○ |
| Ex. 4 | 1.36 | 1.39 | 1.39 | 0.00 | 0.00 | 0.00 | ○ | ○ | ○ |
| Ex. 5 | 1.37 | 1.38 | 1.38 | 0.00 | 0.00 | 0.01 | ○ | ○ | ○ |
| Ex. 6 | 1.39 | 1.41 | 1.42 | 0.01 | 0.00 | 0.00 | ○ | ○ | ○ |
| Ex. 7 | 1.38 | 1.40 | 1.38 | 0.00 | 0.00 | 0.01 | ○ | ○ | ○ |
| Ex. 8 | 1.42 | 1.43 | 1.42 | 0.01 | 0.01 | 0.00 | ○ | ○ | ○ |
| Ex. 9 | 1.41 | 1.41 | 1.41 | 0.00 | 0.00 | 0.00 | ○ | ○ | ○ |
| Ex. 10 | 1.44 | 1.44 | 1.44 | 0.00 | 0.00 | 0.00 | ○ | ○ | ○ |
| Ex. 11 | 1.42 | 1.42 | 1.43 | 0.01 | 0.00 | 0.01 | ○ | ○ | ○ |
| Ex. 12 | 1.39 | 1.39 | 1.40 | 0.00 | 0.00 | 0.01 | ○ | ○ | ○ |
| Comp. Ex. 1 | 1.28 | — | — | 0.02 | — | — | | — | — |
| Comp. Ex. 2 | 1.36 | 1.44 | — | 0.02 | 0.41 | — | ○ | ○ | — |
| Comp. Ex. 3 | 1.38 | 1.45 | — | 0.01 | 0.36 | — | ○ | ○ | — |
| Comp. Ex. 4 | 1.37 | — | — | 0.30 | — | — | | — | — |
| Comp. Ex. 5 | 1.41 | — | — | 0.01 | — | — | ○ | — | — |
| Comp. Ex. 6 | 1.38 | — | — | 0.00 | — | — | ○ | — | — |

TABLE 3

| | Filming After 100,000 sheet running test | Q/M (−μC/g) | | | Fixability (° C.) | | |
|---|---|---|---|---|---|---|---|
| | | First Image | 10,000th image | 100,000th image | Lower fixing temp. | Offset Temp. | Overall Evaluation |
| Ex. 1 | ○ | 30.1 | 29.5 | 30.3 | 140 | 220 | ○ |
| Ex. 2 | ○ | 31.6 | 30.2 | 31.7 | 140 | 220 | ○ |
| Ex. 3 | ○ | 30.5 | 30.6 | 31.2 | 140 | 220 | ○ |
| Ex. 4 | ○ | 32.6 | 30.5 | 30.1 | 145 | 220 | ○ |
| Ex. 5 | ○ | 33.6 | 30.2 | 29.4 | 150 | 220 | ○ |
| Ex. 6 | ○ | 31.9 | 30.7 | 30.4 | 145 | 220 | ○ |
| Ex. 7 | ○ | 34.2 | 31.5 | 29.7 | 150 | 220 | ○ |
| Ex. 8 | ○ | 32.6 | 33.2 | 32.7 | 140 | 220 | ○ |
| Ex. 9 | ○ | 33.3 | 32.8 | 32.6 | 140 | 220 | ○ |
| Ex. 10 | ○ | 27.3 | 28.5 | 26.9 | 150 | 220 | ○ |
| Ex. 11 | ○ | 31.6 | 32.1 | 29.2 | 150 | 220 | ○ |
| Ex. 12 | ○ | 33.4 | 33.5 | 33.3 | 150 | 220 | ○ |
| Comp. Ex. 1 | — | 32.5 | — | — | 190 | 230 | |
| Comp. Ex. 2 | — | 34.6 | 16.7 | — | 175 | 225 | |
| Comp. Ex. 3 | — | 31.9 | 14.6 | — | 170 | 220 | |
| Comp. Ex. 4 | — | 16.1 | — | — | 150 | 220 | |
| Comp. Ex. 5 | — | 32.6 | — | — | 210 | 220 | |
| Comp. Ex. 6 | — | 33.6 | — | — | 180 | 220 | |

As can be understood from Tables 1 to 3, the toner of the present invention can produce images having good fine dot reproducibility, low temperature fixability and offset resistance and less background fouling without contaminating image forming members such as fixing devices. The toner of the present invention can maintain good cleanability for a long period of time.

This document claims priority and contains subject matter related to Japanese Patent Applications Nos. 2001-338406, 2001-338383 and 2002-160694, filed on Nov. 2, 2001, Nov. 2, 2001, and May 31, 2002, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. Toner particles, comprising:

a binder resin;

a colorant; and a particulate resin which is present at least on a portion of a surface of said toner particles and has a glass transition temperature of from 50 to 90° C.;

wherein a ratio (Dv/Dn) of a) a volume average particle diameter (Dv) of the toner particles to b) a number average particle diameter (Dn) thereof is from 1.00 to 1.40; and wherein a ratio of 1) an area of the surface of said toner particles which are covered by said particulate resin to 2) a total area of said surface is from 1 to 90%.

2. The toner particles according to claim 1, wherein said ratio (Dv/Dn) is from 1.00 to 1.20.

3. The toner particles according to claim 1, wherein said glass transition temperature of the particulate resin is from 50 to 70° C.

4. The toner particles according to claim 1, wherein said ratio of 1) to 2) is from 5 to 80%.

5. The toner particles according to claim 1, wherein said binder resin comprises a polyester resin.

6. The toner particles according to claim 5, wherein said binder resin comprises a modified polyester resin and an unmodified polyester resin in a weight ratio of from 5/95 to 80/20.

7. The toner particles according to claim 6, wherein said modified polyester resin is a urea-modified polyester resin.

8. The toner particles according to claim 6, wherein said unmodified polyester resin is a polycondensation product of a polyol with a polycarboxylic acid.

9. The toner particles according to claim 1, wherein said binder resin has an acid value of from 1 to 30 mgKOH/g.

10. The toner particles according to claim 1, wherein said binder resin has a glass transition temperature of from 50 to 70° C.

11. The toner particles according to claim 1, wherein said particulate resin comprises a resin selected from the group consisting of vinyl resins, polyurethane resins, epoxy resins and polyester resins.

12. The toner particles according to claim 1, wherein said particulate resin has an average particle diameter of from 5 to 200 nm.

13. The toner particles according to claim 1, wherein said particulate resin has a weight average molecular weight not greater than 100,000.

14. The toner particles according to claim 1, wherein said toner particles have a volume average particle diameter of from 4 to 8 $\mu$m.

15. The toner particles according to claim 1, wherein said toner particles have a spherical degree of from 0.94 to 0.96.

16. The toner particles according to claim 1, wherein said particulate resin is present on the surface of said toner particles in an amount not greater than 2.5% by weight based on a total weight of said toner particles.

17. A two-component developer comprising:

a toner comprising the toner particles according to claim 1; and a carrier.

18. The two component developer according to claim 17, wherein said carrier is a magnetic carrier.

19. The two-component developer according to claim 17, wherein a weight ratio of said toner to said carrier is from 1/100 to 10/100.

20. The two-component developer according to claim 17, wherein said carrier is selected from the group consisting of iron powders, ferrite powders, magnetic powders and magnetic resin carriers.

21. The two-component developer according to claim 17, wherein said carrier has a particle diameter of from about 20 to about 200 $\mu$m.

22. A developing method, comprising:

developing an electrostatic latent image on an image bearing member with a developer including a toner to form a toner image thereon;

transferring said toner image onto a receiving material;

collecting a toner remaining on a surface of said image bearing member; and returning the collected toner to the developer;

wherein said toner comprises said toner particles according to claim 1.

23. A toner container comprising the toner particles according to claim 1.

* * * * *